US005270476A

United States Patent [19]

Rokkaku et al.

[11] Patent Number: 5,270,476

[45] Date of Patent: Dec. 14, 1993

[54] ELECTRONIC MUSICAL INSTRUMENT

[75] Inventors: Fumio Rokkaku; Takenori Yamamori; Satoshi Otsuka; Mitsuhiro Umeta; Minoru Fujisawa, all of Hamamatsu, Japan

[73] Assignee: Roland Corporation, Osaka, Japan

[21] Appl. No.: 668,989

[22] Filed: Mar. 12, 1991

[30] Foreign Application Priority Data

Mar. 12, 1990 [JP] Japan ..... 2-61986
Aug. 1, 1990 [JP] Japan ..... 2-205897

[51] Int. Cl.[5] ..... G10H 7/00; G04B 13/00; A63H 5/00

[52] U.S. Cl. ..... 84/609; 84/601

[58] Field of Search ..... 84/609-612, 84/626, 627, 649-652, 662, 663

[56] References Cited

U.S. PATENT DOCUMENTS 4,454,797 6/1984 Amano ..... 84/609
4,469,000 9/1984 Fujiwara et al. ..... 84/DIG. 7 X
4,506,580 3/1985 Koike ..... 84/609
4,745,836 5/1988 Dannenberg ..... 84/610
4,898,059 2/1990 Iizuka ..... 84/601
4,960,030 10/1990 Fujimori ..... 84/609
4,982,644 1/1991 Shibukawa ..... 84/601 X
5,129,302 7/1992 Nishikawa et al. ..... 84/601

FOREIGN PATENT DOCUMENTS 56-167196 12/1981 Japan .
61-128295 6/1986 Japan .
2-61986 3/1990 Japan .
2-205897 8/1990 Japan .

*Primary Examiner*—William M. Shoop, Jr.
*Assistant Examiner*—Jeffrey W. Donels

[57] ABSTRACT

An electronic musical instrument is controlled to receive key operation messages from a keyboard, sequencer or the like so as to control the data in such a manner that the disadvantages of a first-in first-out system and a map system are diminished and the newest data can be obtained rapidly. A reading device sequentially reads musical pitches out from a first memory so that it can be decided whether the values indicated on note-on/off flags in a second memory have the same state as the flags in a third memory. A command is issued to generate and/or truncate (or mute) musical tones based on key-depression (i.e., key state) data for the musical pitches registered in the second memory, if the flags are not identical with each other. On the other hand, the key-depression data are discarded without issuing any command if the flags are the same.

18 Claims, 14 Drawing Sheets

| Note No. | Note-on Flag | Velocity Data | Received Data-Processing Flag |
|---|---|---|---|
| 0 | | | |
| 1 | | | |
| 2 | | | |
| 3 | | | |
| | | | |

| Note No. | Note-on Processing Flag | Note-on Velocity | Note-off Processing Flag | Note-off Velocity | Number of Received Note-on Messages |
|---|---|---|---|---|---|
| 0 | | | | | |
| 1 | | | | | |
| 2 | | | | | |
| 3 | | | | | |

ELECTRONIC MUSICAL INSTRUMENT

BACKGROUND OF THE INVENTION

1. Field of the Invention

The present invention relates to an electronic musical instrument, and more particularly, to a system therein for receiving and processing the key state data supplied from a keyboard, sequencer or the like.

2. Description of Related Art

Electronic musical instruments are generally constructed such that various processings such as the allotting of musical tone-generating channels channels to key state data or key operation data will be effected based on the received key state data It is to be noted that the key state data are produced in electronic musical instruments independently of the progress of the processings of key-depression or key-release, because such key state data correspond to keyboard operation per se including key-depression and key-release, or correspond to the reading of music information out of a sequencer Therefore, it is necessary for the received key state data to be temporarily stored in a memory device so that it can be read on demand and in response to the progress of the processings. The following systems are used for temporary storage of the key state data.

First-in First-out System: Received key state data are sequentially written into a register called "FIFO", in the order of reception, according to the reception interrupt routine. The temporarily stored data are then read sequentially out of the FIFO and delivered to the main routine so as to execute the key-depression or key-release processings.

Map System: A new-note map and an older-note map are employed, with the former map registering the received key state data and recording their musical pitches, wherein the latter map registers for each musical pitch the commands given to the musical tone-generating channels to carry out the processing of key-depression or key-release. The contents of the new-note and older-note maps are sequentially compared with each other. If there is found any difference between these maps, then or the key-depression or -release processings are effected depending on the key state data registered on the new-note map.

SUMMARY OF THE INVENTION

The first-in first-out system is advantageous in that the key state data to be processed can be obtained rapidly, and in that all of the received data can be processed one by one without missing any data. "Glissand" playing on keyboard will produce in a short time a number of consecutive key operation data, which in this system are to be processed in a consecutive manner. Thus, the processing of key-depressions or key-releases cannot be effected in good time, thereby delaying the generation of musical tones to such a degree that the musical feeling is spoiled. There is another problem that some older key state data may be lost, if the capacity of used memory in the first-in first-out system is insufficient.

On the other hand, the map system is characterized in that the processing is executed based upon the newest key state data when number of data are received in a short time. This feature is advantageous in that undesirable increase of key-depression or key-release processings can be avoided. Reference is made here again to the "glissando" operation of keyboard in which a number of repeated key-depressions and key-releases take place in a short time and close to each other. If in such a case superfluous key state data causes the processing to be delayed, some key-release data may be received before the preceding key-depression data have been processed. The new-note map will be renewed to indicate that key-release processing is currently effective. As a result, the system can not necessarily treat all of the key state data, whereby some key state data are discarded as if there were no change in operation of the same key with respect to the neglected data. From one aspect of the matter, this is desirable since the spoiled musical feeling is avoided which may be produced due to the "one-by-one" processing of all the consecutive key-depressions and key-releases in the first-in first-out system. However, this map system has such a problem that it takes a longer time to obtain the necessary key state data from the new-note map. Further, the alternately repeated data such as "note-on and note-off and note-on" are produced for the same note number in the so-called "chattering" operation of keyboard will result in a delayed processing of the data. Such a delay will bring about a possibility that, if the succeeding note-on is received before the processing of the preceding note-on and note-off, the velocity data of the preceding note-on will be renewed to be that of the succeeding note-on. It will be now understood that the velocity of the succeeding note-on in the "chattering" is likely to be less than that of the preceding note-on. This means that it is difficult to assure the intended tone intensity or key touch for the succeeding note-on. It is also a drawback of the map system that multiple note-on messages from the sequencer will be processed as a single note-on message, thereby disabling the multiple generating of plural tones for the same note number.

An object of the present invention is to resolve the aforementioned problems in the prior art systems, is and therefore, provide an electronic musical instrument in which the drawbacks of the first-in first-out system and the map system are compensated with the advantages of the map system and the first-in first-out system, respectively.

In order to achieve this object, the electronic musical instrument in the invention comprises characteristic components illustrated in FIG. 1A and outlined as follows.

From one aspect of the present invention, the characteristic components are:

(a) a first memory for sequentially storing at least musical pitches included in received key-depression messages so that the stored musical pitches can be sequentially read out from the first memory in the manner of first-in first-out;

(b) second a memory, being a map memory, for registering the received key-depression messages and corresponding to the musical pitches included in each received key-depression message, the key-depression messages include a first type note-on flag which indicates that a command to generate and/or truncate the musical tone is to be issued;

(c) a third memory, being another map memory, for registering a second type note-on flag and corresponding to the musical pitches, the second type note-on flags each indicating whether the command to generate and/or truncate the musical tone has or has not been issued to a musical tone-generating device based on the received key-depression messages;

(d) a reading device for sequentially reading the musical pitches out from the first memory in the manner of first-in first-out;

(e) a comparing device for comparing each first type note-on flag in the second memory with each second type note-on flag in the third memory, in response to each musical pitch which is read by the reading device, so as to decide whether the first type note-on flag and the second type note-on flag have or have not the same state: and (f) a processing device for issuing the command to the musical tone-generating device to generate and/or truncate the musical tone in response to operation of the comparing device 5, with the command being issued based upon the key-depression message registered in the second memory and including the first type note-on flag corresponding to the musical pitch read by the reading device, the processing device further causing the second type note-on flag, corresponding to the musical pitch read by the reading device in the third memory to coincide to the state of the corresponding first type note-on flag.

From another aspect of the present invention, the characteristic components are:

a) a first memory for sequentially storing at least musical pitches included in received key-operation messages so that the stored musical pitches can be sequentially read out from the first memory in the manner of first-in first-out;

(b) a second memory, being a map memory, for registering the received key-operation messages and corresponding to the musical pitches included in each received key-operation message, the key-operation messages include a first type note-on/off flag which indicates that a command to generate or mute the musical tone is to be issued;

(c) a third memory, being another map memory, for registering the received key-operation messages and corresponding to the musical pitches, the key-operation messages include second type note-on/off flags each indicating whether the command to generate or mute the musical tone has or has not been issued to a musical tone-generating device based on the received key-operation messages;

(d) a reading device for sequentially reading the musical pitches out from the first memory in the manner of first-in first-out;

(e) a comparing device for comparing each first type note-on/-off flag in the second memory with each second type note-on/off flag in the third memory, in response to each musical pitch which is read by the reading device, so as to decide whether the first type note-on/-off flag and the second type note-on/off flag have or have not the same state; and (f) a processing device for issuing the command to the musical tone-generating device to generate or mute the musical tone in response to operation of the comparing device 5', with the command being issued based upon the key-operation message registered in the second memory and including the first type note-on/off flag corresponding to the musical pitch read by the reading device, the processing device further causing the second type note-on/off flag corresponding to the musical pitch read by the reading device in the third memory to coincide to the state of the corresponding first type note-on/off flag.

The musical pitches in the abovementioned two cases are read in sequence by the reading devices from the first memory, in the manner of first-in first-out. The first type note-on (or note-on/off) flag registered in the second memory and corresponding to the musical pitches are then compared with the second type note-on (or note-on/off) flag in the third memory , respectively by the comparing device. If the note-on (or note-on/off) flag is decide by the comparing device as not having the same state as that of the corresponding second type note-on (or note-on/off) flag, then the processing device issues a command to the tone generating device to generate and/or truncate (or mute) the musical pitch, based upon the key-depression ( key-operation) data registered in the second memory corresponding the musical pitch. If, on the other hand, the first type note-on (or note-on/off) flag and the corresponding second type note-on (or note-on/-off) flag have the same state, the processing device does not execute such an operation as just described above, but the key-depression (key-operation) data will be discarded without use.

Further, an electronic musical instrument may be provided with an overflow detecting means for deciding whether the first memory is or is not overflowing, wherein the comparing device compares the first type note-on flag registered in the second memory with the second type note-on flag in the third memory corresponding to the musical pitch read by the reading device if the detecting device decides that the first memory device is not overflowing, whereas the comparing means compares in a predetermined order the first type note-on flag registered in the second memory for the musical pitches with the second type note-on flags in the third memory, if the detecting device decide that the first memory is overflowing.

The object of the present invention will also be achieved by providing an electronic musical instrument as shown in FIG. 1B and comprises:

(a) first memory means 1" for sequentially storing at least musical pitches included in received key-depression messages so that the stored musical pitches can be sequentially read out from the first memory in the manner of first-in first-out;

(b) a second memory, being a map memory, for registering said received key-depression messages and corresponding to the musical pitches included in each included in received key-depression messages, the key-depression message include a note-on flag which indicates that a command to generate and/or truncate the musical tone is to be issued;

(c) a third memory, being another map memory, for registering the processed-state data, regarding generating and/or truncating of the musical tone for a musical tone-generating device based on the received key-depression messages and corresponding to each musical tone;

(d) a setting device for renewing the contents of the processed-state data regarding the generating and/or truncating of musical tone for the musical tone generating device which have been registered in the third memory and corresponding to each musical pitch included in each received key-depression message so as to indicate an unprocessed state;

(e) a reading device for sequentially reading the musical pitches out of the first memory in the manner of first-in first-out;

(f) a detecting device for deciding whether each processed state data which has been registered in the third memory is or is not indicating unprocessed state of each musical pitch, in response to each musical pitch which is read by the reading device; and (g) a processing device for issuing the command to the musical tone-generating device to generate and/or truncate the musical tone in a case wherein the detecting device 8 has decided that the musical pitch has not yet been processed, with the command being issued based upon the key-depression message which has been registered in the second memory and includes the note-on flag, indicating that the musical pitch is to be generated and/or truncated, corresponding to the musical pitch read by the reading device, the processing device further causing the processed-state data in the third memory to be renewed to indicate that the musical pitch has now been processed.

From a still another aspect of the invention, the electronic musical instrument may comprise the following components. Namely, (a) a first memory for sequentially storing at least musical pitches included in received key-operation messages so that the stored musical pitches can be sequentially read out from the first memory in the manner of first-in first-out;

(b) a second memory, being a map memory, for registering the received key-operation messages and corresponding to the musical pitches included in each the received key-operation message, the key-operation messages include a note-on/off flag which indicates that a command to generate or mute the musical tone is to be issued; (c) a third memory, being another map memory, for registering the processed-state data, regarding generating or muting of the musical tone for a musical tone generating device based on the received key-operation messages and corresponding to each musical tone;

(d) a setting device for renewing the content of the processed-state data regarding the generating or muting of musical tone for the musical tone generating device which has been registered in the third memory and corresponding to each musical pitch included in each received key-operation messages so as to indicate an unprocessed state;

(e) a reading device for sequentially reading the musical pitches out from the first memory in the manner of first-in first-out;

(f) a detecting device for deciding whether each processed state data which has been registered in the third memory is or is not indicating unprocessed state of each musical pitch in response to each musical pitch which is read by the reading device and (g) a means for issuing the command to the musical tone-generating device to generate or mute the musical tone when the detecting device has decided that the musical pitch has not yet been processed, with the command being issued based upon the key-operation message which has been registered in the second memory and includes the note-on/off flag, indicating that the musical tone is to be generated or muted, corresponding to the musical pitch read by the reading device the processing device further causing the processed-state data in the third memory to be renewed to indicate that the musical pitch has now been processed.

The musical pitches in the abovementioned two cases are also read in sequence by the reading device out from the first memory in the manner of first in first-out. Subsequently, the detecting device will decide in response to each musical pitch whether each processed-state data in the third memory is or is not indicating unprocessed state of the musical pitch, wherein each processed-state data is renewed to indicate the unprocessed state in response to each received key-operation data. If the processed-state data is decided by the detecting device to indicate the unprocessed state, the processing device issues a command to the tone generating device to generate and/or truncate (or mute) the musical pitch, based upon the key-depression (key-operation) data registered in the second memory corresponding to the musical pitch. If, on the other hand, the processed-state data is decided to indicate the processed state, the processing device does not execute such an operation as just described above, but the key-depression (key-operation) data will be discarded without use.

Further, an electronic musical instrument may be also provided with an overflow detecting device for deciding whether the first memory means is or is not overflowing, wherein the deciding device decides whether the processed-state data registered in the third memory means and corresponding to the musical pitch read by the reading is or is not indicating that the musical pitch is unprocessed, if the overflow detecting device decides that the first memory is not overflowing, whereas the deciding device decides in a predetermined order whether the processed-state data registered in the third memory for the musical pitches are or are not indicating that the musical pitches have not yet been processed, if the detecting device decides that the first memory is overflowing.

It will now be apparent that the simple first-in first-out system and simple map system are improved in the present invention by compensating their disadvantages with their advantages, respectively. The necessary newest key-depression (or key-operation) messages can now be obtained quickly to be processed subsequently.

The second memory may register current note-on velocity data which are respectively included in the key-depression messages so as to correspond to the musical pitches and are to be renewed with new note-on velocity data only when a processing to generate and/or truncate the musical tones for the current note-on velocity data is already finished. Alternatively, the second memory also may register current note-on velocity data which are respectively included in the key-depression (operation) messages and are to coincide to new note-on velocity data when the new note-on velocity data are greater than the current note-on velocity data, on which the process is not yet executed, regarding generating and/or muting of the musical tone in response to each musical pitch which is included in the key-depression (operation) messages.

Furthermore, in case of detecting overflow state in the abovementioned overflow state detecting device, the indication that the musical pitch information is lost is given.

Other objects and advantages of the present invention will become apparent from the preferred embodiments which will be described hereinafter by referring to the drawings, which embodiments however do not limit the scope of the invention.

BRIEF DESCRIPTION OF THE DRAWINGS

The present invention will become more apparent from the preferred embodiments which are not limitative of the present invention but will be described by way of illustration by referring to the accompanying drawings, in which:

FIGS. 2 to 13 illustrate an electronic musical instrument according to a first embodiment of the invention; wherein FIG. 2 is a schematic diagram;

FIG. 3 shows a new-note map formed on a RAM;

FIGS. 4 to 7 are flowcharts of a main routine, a note-FIFO processing routine, a note-FIFO overflow routine and a reception interrupt routine, respectively;

FIG. 8 is a flowchart of Step Z-15 which is included in the reception interrupt routine and modified for a fifth modification of the embodiment;

FIGS. 9 to 13 illustrate a sixth modification and are the new-note map on the RAM corresponding to FIG. 3, a modified Step Z-15 in the reception interrupt routine, modified Steps F3, F5 and F6 of the note-FIFO processing routine, respectively.

THE PREFERRED EMBODIMENTS

The electronic musical instrument in the preferred embodiments of the invention will now be described in detail with reference to the drawings.

FIRST EMBODIMENT

Figure 1A:
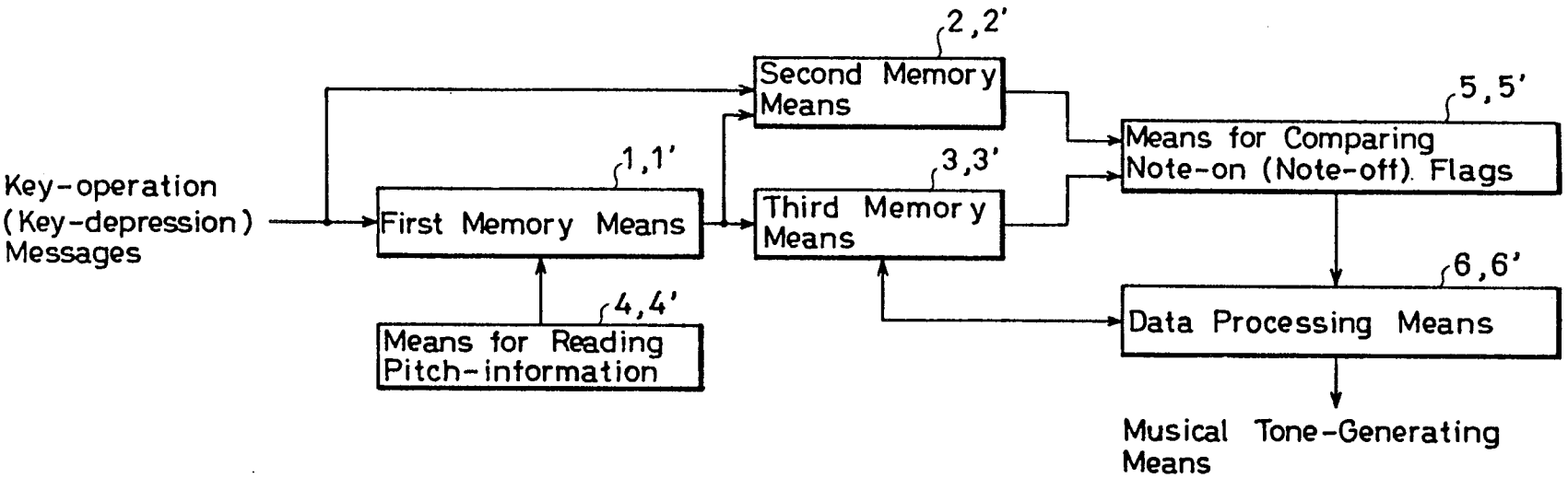
FIGS. 1A and 1B are block diagrams showing the characteristic features defined in the claims.
Figure 1B:
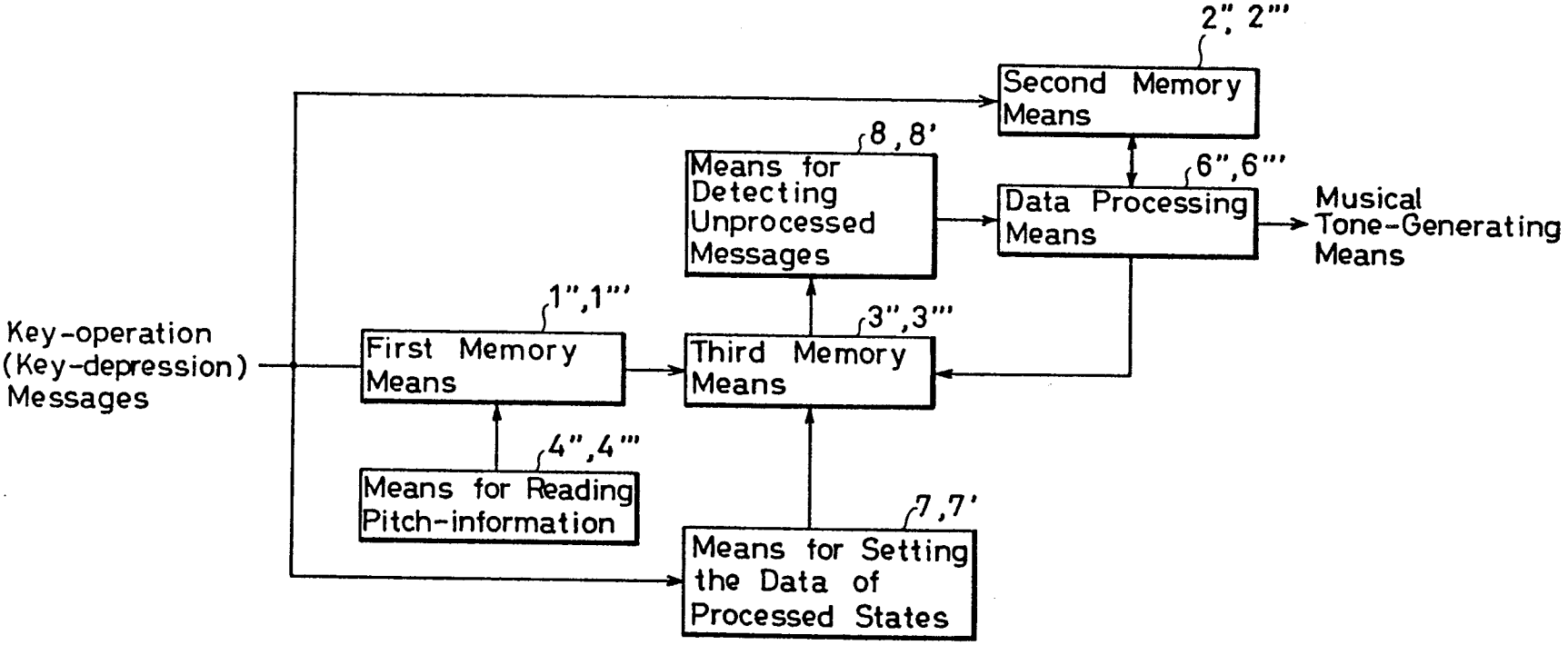
Figures 2, 3:
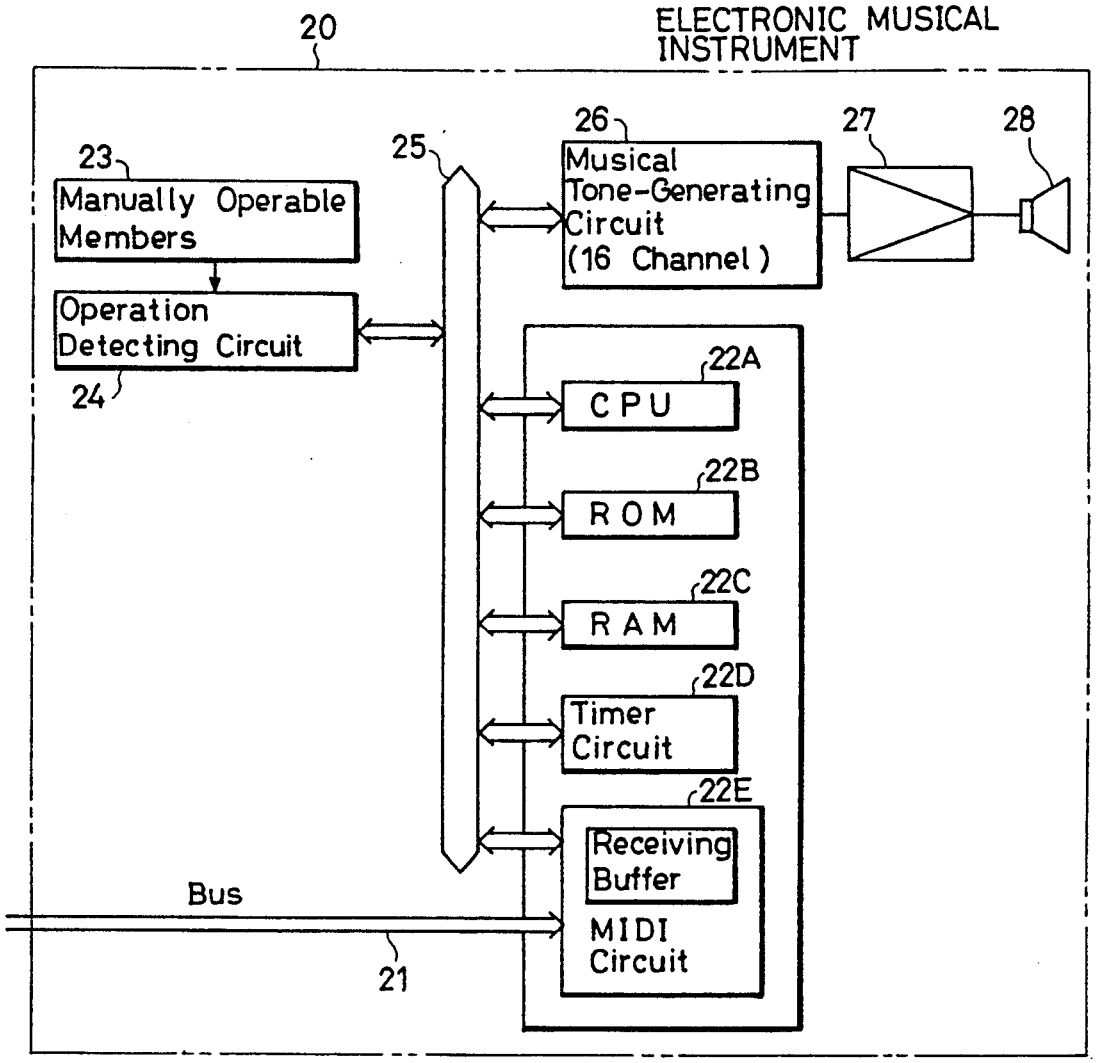

In FIG. 2 schematically showing an electronic musical instrument 20, MIDI messages each include a key-depression/release message from a keyboard or sequencer not shown, the MIDI messages being delivered to a micro-computer 22 through an MIDI bus 21. The microcomputer 22 comprises: a central processing unit (CPU) 22A for the execution of predetermined programs; a read only memory (ROM) 22B for previously storing the programs as well as data and tables necessary for various processings; a random access memory (RAM) 22C having working areas for various registers, FIFOs and maps which are used to execute the programs; a timer circuit 22D for causing interrupts to the CPU 22A at regular intervals of time (for example, 5 milliseconds); and an MIDI circuit 22E having a receiving buffer of first-in-first-out type. A plurality of manually operable members 23 are used to select timbres and to set parameters relevant to the timbres. The operated states of the manually operable members are detected by an operation detecting circuit 24 under control by the CPU 22A so that the detected data are delivered through a bus 25 to a predetermined register in the working area of the RAM 22C so as to be written therein as operable member data. The aforementioned MIDI messages including the key-depression/-release messages are supplied to and stored in the receiving buffer of the MIDI circuit 22E.

The MIDI messages stored in the receiving buffer as well as the operable member data written in the predetermined register in the working area of RAM 22C are used by the microcomputer 22 to execute the predetermined programs stored in ROM 22B, in order to control a musical pitch-generating circuit 26 which comprises sixteen tone generating channels in this embodiment. Those tone-generating channels produce required tone signals which are to be fed to an amplifier 27 and then converted into audible sounds by a loudspeaker 28. Before describing the performance of the electronic musical instrument 20 constructed as above, musical note maps and a note FIFO which are located in the working areas of RAM 22C will be summarized at first.

New-Note Map (see FIG. 3)

Written in this map having addresses corresponding to the note numbers "0" to "127" are: (1) a note-on flag indicating the key-depression/release states; (2) velocity data indicating such key touches as detected when the keys are depressed or released; and (3) a received data-processing flag indicating whether a processing based upon the key operation messages has finished or not. At the initialized state of the new-note map, the note-on flag is "0", the velocity data is "64", and the received data-processing flag is "0".

* Older-Note Map

Corresponding to the new-note map, this older-note map also is adapted to store the note-on flag (1) indicating the key-depression/-release states for the note numbers "0" to "127" as the addresses.

* Note FIFO

This memory area is adapted to store the note numbers and is of an imaginary-ring-like structure comprising reading and writing pointers so that the reading or writing of note numbers is carried out with respect to the addresses indicated by the pointers. The pointers are relocated incrementally every time a reading or writing operation is done. Current state of the note FIFO can be identified in the following manner.

If the writing of data commences from the initialized state, then the writing pointer will move ahead of the reading pointer. This shows a state that the data are being written in the note FIFO so that vacancy thereof is broken. If the reading of data advances sufficiently, then the reading pointer will catch up with the writing pointer, thus indicating the vacancy of the note FIFO. In another case wherein a superfluous amount of data are written in the note FIFO, the writing pointer will make one turn around the ring and go ahead of the reading pointer. This is an overflow state in which new data are superimposed on the older data which have not yet been read out of the note FIFO.

The registers on which various parameters, buffers, flags, pointers and the likes are written are allotted to the predetermined portions of the working area in RAM 22C, but are not described here in detail.

Main Routine

Figure 4:
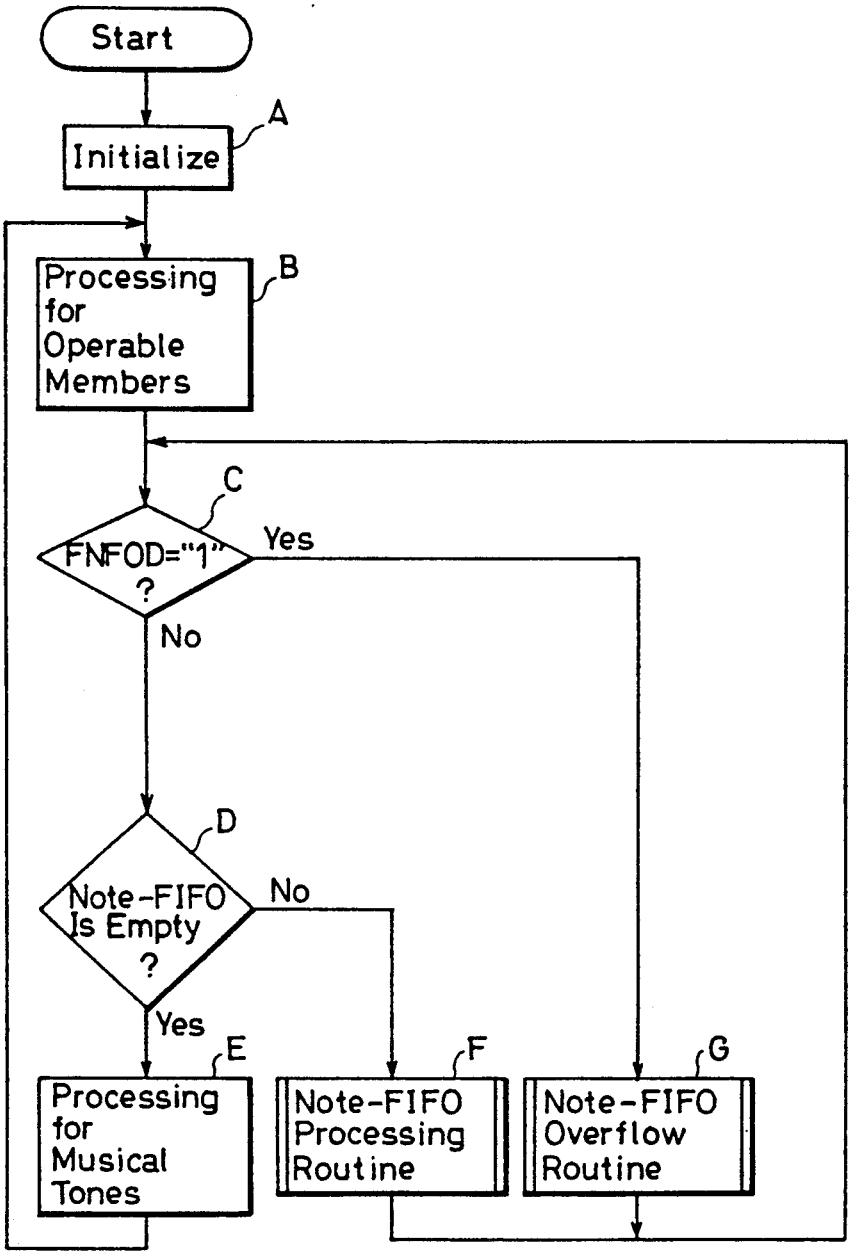

Basic operation of the electronic musical instrument in the invention will now be described referring to FIG. 4 which shows a flowchart of main routine.

Step A

With a power source turned on, the predetermined programs start to operate and the the working area of RAM 22C is initialized so that its portions are allotted to the registers. Command signals are given to the timer circuit 22D, MIDI circuit 22E, operation detecting circuit 24 for the operable members and musical pitch-generating circuit 26 so as to initialize them. The value "1" is set to the receiving MIDI channel number.

Step B

Operated states of the manually operable members 23 are read from the operation detecting circuit 24, and the parameters relating to the timbres are predetermined at this step.

Step C

A decision is made as to whether an overflow detecting flag FNFOD is or is not "1", in order to decide if note FIFO is in its overflow state or not. If yes at this decision, then the process skips to Step G for overflow processing. It is noted that the reception interrupt routine mentioned later will set "1" to the overflow detecting flag when overflow occurs in the note FIFO.

Step D

If no at the decision made at Step C, then a further decision will be made as to whether the note FIFO is or is not empty. In a case wherein the note FIFO is not empty, the process will skip to Step F to handle the data accumulated in the note FIFO. After the process of the musical tones in the tone generating channels, the process returns to Step B.

Step E

If on the contrary the note FIFO is found empty at Step D, then envelope waveforms which are being generated through some of the tone generating channels, to which the timbres and parameters are allotted previously, are controlled in a consecutive manner. In detail, the tone generating channels currently generating the musical tones are processed for example to maintain the envelopes changing in course of time in predetermined manner. After process of the musical tones in the tone generating channels, the process returns to Step B.

Step F

This step is the note-FIFO processing routine which will be described later referring to the flowchart shown in FIG. 5. The process returns to Step C after the processing at this step is finished.

Step G

This step is the note-FIFO overflow routine which will be described later referring to the flowchart shown in FIG. 6. The process returns to Step C after the processing at this step is finished.

Reception Interrupt Routine

Figure 7:
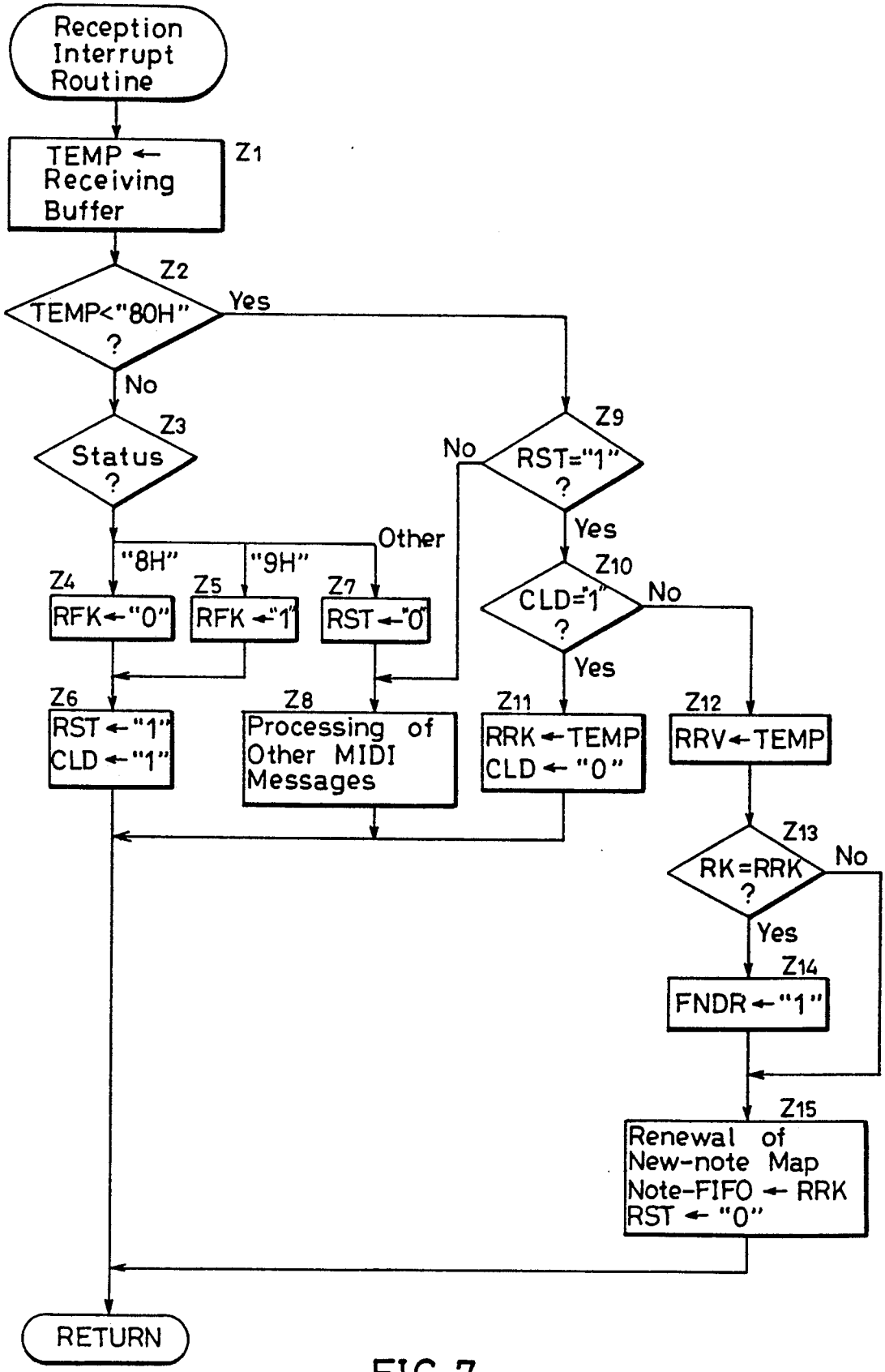

In this routine shown in FIG. 7, each reception interrupt takes place every time when one byte of MIDI message given through the MIDI bus 21 is received by the signal receiving buffer of MIDI circuit 22E. The following processing will be conducted for each reception interrupt.

Step Z-1

The one byte of MIDI message is read from the receiving buffer and is named as "temporary data" TEMP which means a transient data under processing.

Step Z-2

A decision is made as to whether the temporary data TEMP is a status byte or is a data byte, depending upon whether the value of said temporary data TEMP is or is not less than "80H". If the temporary data TEMP is the data byte of the MIDI message since it is less than "80H", then the process skips to Step Z-9.

Step Z-3

If the temporary data TEMP is found to be the status byte of MIDI message since it is not less than "80H", then the type of MIDI message on said data TEMP will be distinguished from other types according to whether four upper bits of the temporary data TEMP is "8H", "9H" or any other value. The four trailing bits are used to identify the MIDI channel number.

Steps Z-4 and Z-5

If it is confirmed at Step Z-3 that the four upper bits of the temporary data is equal to "8H" and the MIDI channel number is included in those MIDI channel numbers which are specified at that instant to receive the messages, then the value "0" is set to a reception note-on flag RFK since the status byte on MIDI message on the temporary data TEMP represents the state of "note-off". In another case wherein the four upper bits of the temporary data is equal to "9H", the value "1" is set to the reception note-on flag RFK since the status byte of MIDI message on the temporary data TEMP represents the state of "note-on".

Step Z-6

The value "1" representing the state of note-off or note-on is set to a message code RST which indicates the type of the MIDI message in issue. Further, the value "1" is also set to a data byte step CLD which indicates the step for decoding the status byte included in the MIDI message on the temporary data TEMP. With these procedures completed, the reception interrupt routine is finished.

Step Z-7

If it is confirmed at Step Z-3 that the four upper bits of the temporary data is not equal to "8H" nor to "9H" and the MID channel number is included in those MIDI channel numbers which are specified at that instant to receive the messages, or if it is confirmed that the MIDI channel number is not included in the MIDI channel numbers specified to receive the messages, then the value "0" indicating that the MIDI message in issue is neither an MIDI message corresponding to note-on nor corresponding to note-off will be set to the message code RST.

Step Z-8

This step is executed for processing other MIDI messages irrelevant to the invention in the known conventional manner so that no description thereof is given here. The current reception interrupt routine will end when the Step Z-8 is finished.

Step Z-9

If it is found at Step Z-2 that the temporary data TEMP is less than "80H" and therefore is the data byte of the MIDI message in issue, then a decision is made as to whether the message code RST indicating the type of the MIDI message is or is not "1". If no, the process goes to Step Z-8 because the temporary data TEMP is the data byte of such MIDI message which corresponds neither to note-on nor to note-off.

Step Z-10

If yes at the decision made at Step Z-9, then a further decision is made as to whether the data byte step CLD which indicates the step for decoding the data byte included in the MIDI message on the temporary data TEMP is or is not "1". If no, then the process advances to Step Z-12.

Step Z-11

If yes at the decision made at Step Z-10, the temporary data TEMP indicates the note number and therefore is defined as a received note number RRK, and the data byte step CLD is initialized to "0" before the reception interrupt routine ends.

Step Z-12

If no at decision made at Step Z-10, the temporary data TEMP indicates a velocity data and therefore is defined as a received velocity data RRV.

Steps Z-13 and Z-14

A decision is made as to whether the received note number RRK is or is not equal to a note number RK which is being handled in the note-FIFO processing routine and/or note-FIFO overflow routine. If yes, then the value "1" is set to a data-receiving flag FNDR.

Step Z-15

The received note number RRK is inputted into the note FIFO, and the new-note map is renewed, with the value "0" being set to the message code RST before the reception interrupt routine is finished. During or after such procedures, the value "1" is set to an overflow detecting flag FNFOD in a case wherein the note FIFO is in its overflow state. The renewal of the new-note map is done in such a manner that the note-on flag for the note number corresponding to the received note number RRK is set to the reception note-on flag RFK, the current velocity data is set to the received velocity data RRV, the value "1" is set to a received data-processing flag. In addition, the value "0" is set to the note-on flag, with the velocity data being renewed to "64", if the reception note-on flag RFK carries the value "1", with the received velocity data RRV indicating "0".

Summarizing this routine, the note-on flag is read from the status byte of MIDI message and first and second data bytes thereof are used as the note number and as the velocity data, respectively, when the MIDI message is received which indicates the note-on or note-off for the predetermined MIDI channel. After the message is fully received, the note number will be inputted into the note-FIFO and the new-note map will be renewed. The value "1" will be set to the data-receiving flag FNDR, if the received note number RRK has the same state as the note number RK which is being processed in the note-FIFO processing routine or other routines.

In the event that the MIDI message would be such an MIDI message as pertinent to the "running status", the inhibitory conditions should be canceled at first before the aforementioned processing is executed (see MIDI Standard 1.0, Document Ver. 4.1).

It is also noted that when the reception interrupt is commanded while an interrupt is disabled, the note-FIFO and other processing must be executed after the interrupt is enabled.

Figure 5:
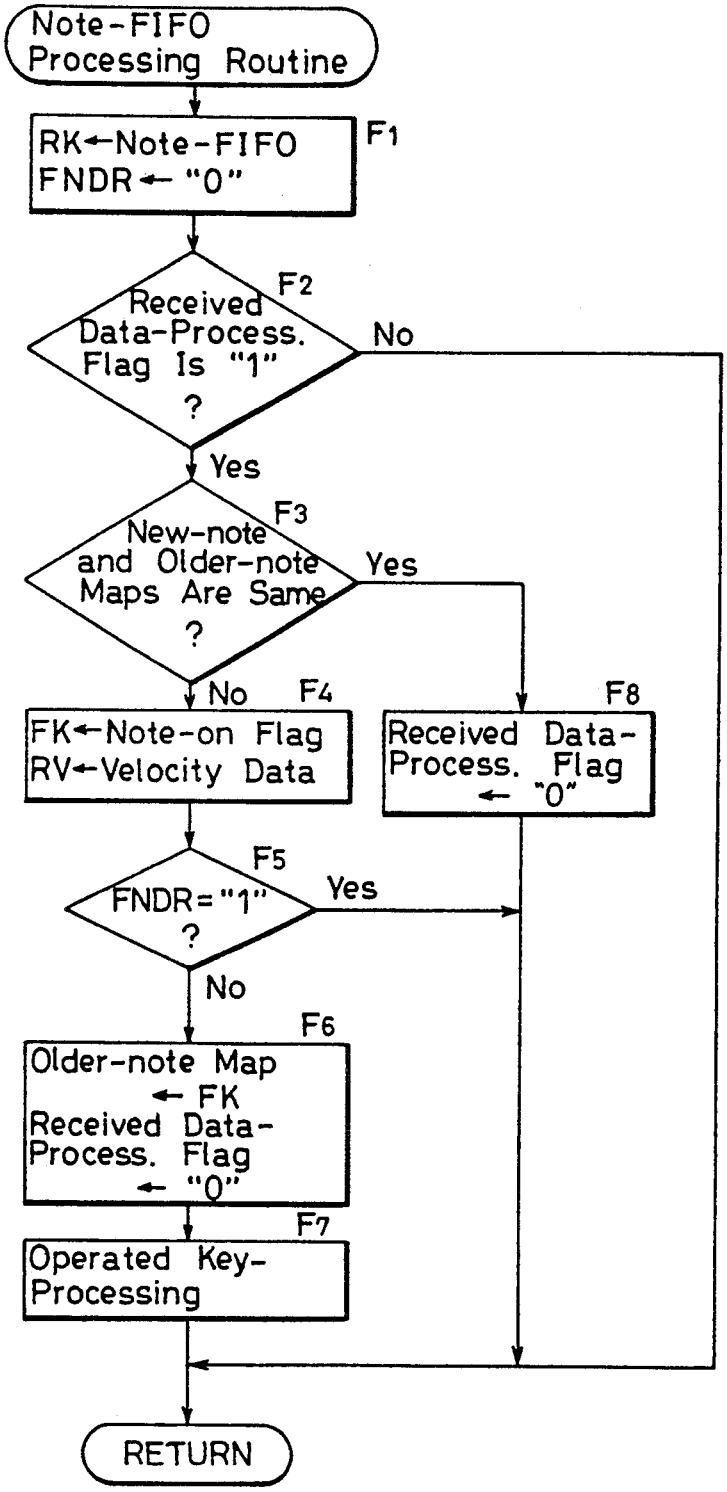

Note-FIFO Processing Routine (see FIG. 5)

Step F-1

One byte is to be outputted at first from the note-FIFO so as to be used as the note number RK, with the data-receiving flag FNDR being set to "0".

Step F-2

A decision is made as to whether the received data-processing flag is or is not "1", which flag is for a note number on the new-note map and corresponds to the note number RK. If no, the process returns to the main routine since the processing of data corresponding to the note number is already finished.

Step F-3

If yes at the decision made at Step F-2, the reception interrupt is disabled, and a further decision is made as to whether the note-on flag for the note number which corresponds to the note number RK and is written on the new-note map is or is not the same as that of the note-on flag for the note number on the older-note map. If yes, the process skips to Step F-8 since the key operation messages issue is of the same type as that of the other key operation messages which has been processed already.

Step F-4

If no at the decision made at Step F-3, then the note-on flag for the note number which corresponds to the note number RK and is written on the new-note map will be defined as a note-on flag FK. Further, the velocity data for the note number which corresponds to the note number RK and is written on the new-note map will be defined as a velocity data RV, thereby enabling reception interrupts.

Step F-5

Reception interrupt is disabled, and a decision is made as to whether the data-receiving flag FNDR is or is not "1". If yes, the process returns to the main routine after enabling reception interrupts, because a new key operation messages has been received at Step F-3 as to the note number in issue so that the current key operation messages is no more the newest one.

Step F-6

If no at the decision made at Step F-5, the note-on flag for the note number which corresponds to the note number RK and is written on the older-note map will be defined as the note-on flag FK. Further, the value "0" is set to the received data-processing flag for the note number which corresponds to the note number RK and is written on the new-note map, and the reception interrupts is enabled.

Step F-7

An operated key-processing is executed depending upon the state of the note-on flag FK in the following manner.

STAGE-1: A decision is made, by referring to the note-on flag FK, as to whether the key operation in issue is key-depression or key-release. If the note-on flag is "1" to indicate key-depression, then the newly depressed key is allotted to one of such tone generating channels as are at that instant idle and generating no musical pitch and thus are capable of being allotted to the new key-depression. In a case wherein no such idle channel is found, one of the currently operating channels which are generating musical tones at that instant will be selected to be subject to the muting in other words truncating operation of musical tones. This operation may be conducted according to the method which is disclosed on the Japanese Laid-open Gazette No. 1-198798 of the patent application filed by the present applicant. If however any unused tone generating channel cannot be found, then the process may return to the main routine. In this case, the generating of musical pitch based on the preceding key operation messages is dispensed with so as not to impede the progress of the processing of any succeeding key operation messages.

STAGE-2: Next, a pitch, envelope waveform, timbre and other parameters of musical pitch are calculated or produced according to the method known in the art on the basis of the note number RK and velocity data RV. Those calculated or produced parameters including the pitch and so on will then be written into the tone generating channel which will have been selected at the STAGE-1. Thus, the selected channel generates a desired musical pitch since a command is given to said channel before the process returns to the main routine.

STAGE-3: In case of the note-on flag FK is "0" indicating a key-release, the aforementioned known method is relied upon also to search any tone generating channel which corresponds to the note number RK and is currently generating any musical pitch. If such a channel is found, a key-release envelope will be calculated and produced according to the velocity data RV for the released key. Parameters of the key-release envelope will be written into the tone generating channel found in the manner mentioned above. Before the process returns to the main routine, a command is given to this tone generating channel to execute a released-key processing so as to cause the musical pitch to change in course of time and be finally muted. However, the process will directly return to the main routine when no tone generating channel corresponding to the note number RK is generating a musical pitch.

Step F-8

The value "0" is set to the received data-processing flag with respect to the note number which is in the new-note map and corresponding to the abovementioned note number RK. The reception interrupts is enabled before the process returns to the main routine.

In summary, the processing is executed at this step in such a manner that at first the note number is outputted from the note FIFO, then reference is made to the received data-processing flag in respect of the new-note map, and next the note-on flags for the new- and older-note maps are compared with each other. If the key operation messages in issue is to be processed at that instant, the afore-mentioned operated key-processing is executed for the key operation messages relating to the new-note map. If, however, a new key operation messages which has just been received is considered at Step F-5 to be relevant to the other preceding key operation messages, the operated key-processing will be broken off to execute a processing on the basis of the newest key operation messages.

Alternatively, the decision at Step F-5 may be dispensed with in order that the processing is continued based on the key operation messages which has been effective until that instant referred to above. It is also possible that the process is caused to directly return to Step F-3 from Step F-5 where the data-receiving flag FNDR is judged to be "1", in order to immediately initiate the processing based on the newest key operation messages. It is still possible to conduct also at the step of operated key-processing a processing which is having the same state as or similar to Step F-5. In detail, here is made a decision as to whether the key operation messages in issue is or is not the newest one so that any generation of musical pitch and/or the released key-processing which are not based upon the newest key operation messages is stopped promptly. Such a decision may be made alternatively at an instant just before the command to generate musical pitch is given to the tone generating channel, thereby preventing this channel from generating musical pitch. In this latter case, the processing which has been described at Step F-6 has to follow the last procedure in the aforementioned processing which is the same as or similar to Step F-5. When a decision is finished at the same or similar processing which is not a final processing, the reception interrupts is to be enabled.

Further, when a new key operation message which relates to the other preceding key operation messages is received during the reception interrupt routine, the process may be controlled to return to the main routine or Step F-3.

Figure 6:
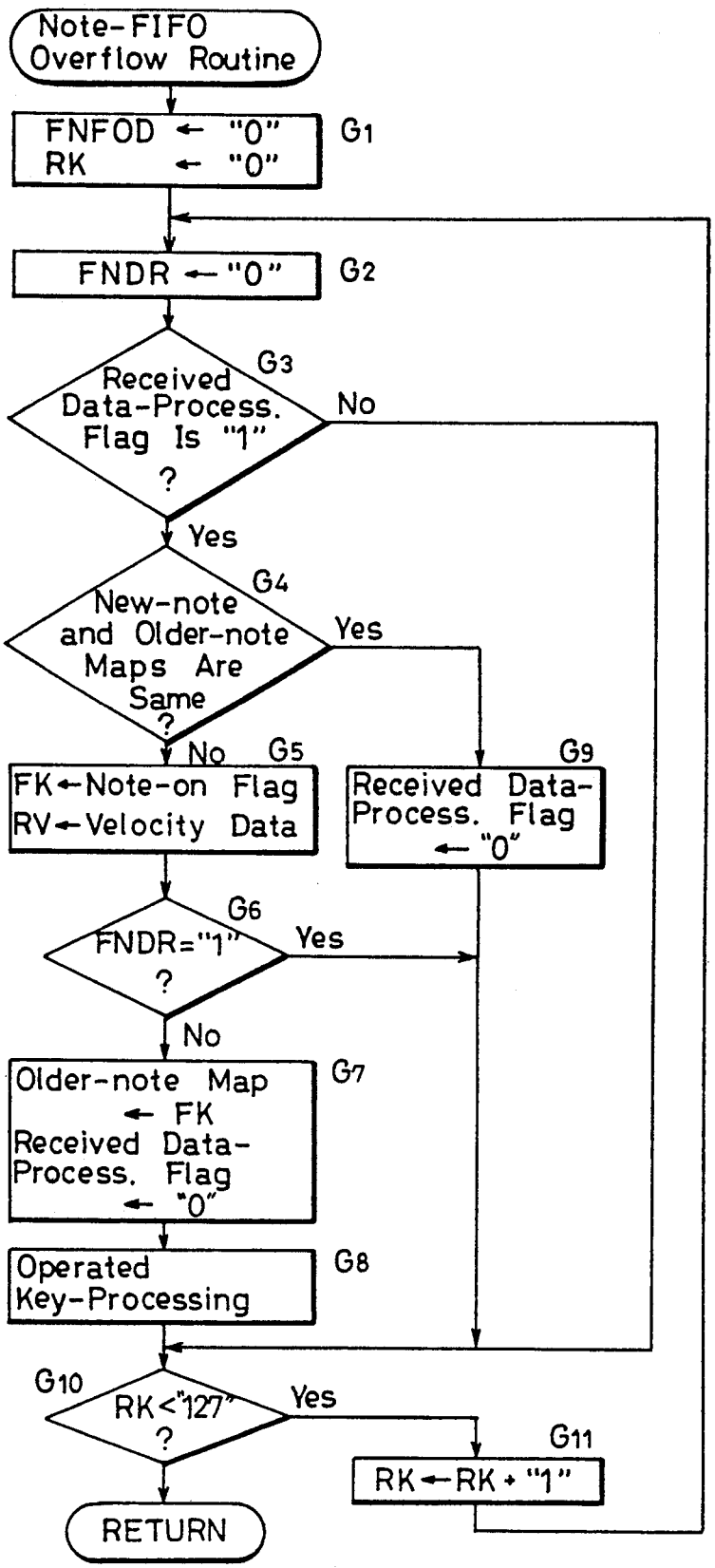

Note-FIFO Overflow Routine (see FIG. 6)

Step G-1

The reception interrupt is disabled at first, with the writing and reading pointers of the note-FIFO being initialized. The memory written in the note-FIFO is then cleared, and the value "0" is set to the overflow detecting flag FNFOD and to the note number RK. Subsequently, the reception interrupts is enabled.

Step G-2

The value "0" is set to the data-receiving flag FNDR.

Steps G-3 to G-9

Conducted here are procedures which are the same as or similar to those procedures comprising the Steps F2 to F8 in the aforementioned note-FIFO processing routine. However the process does not return to the main routine but goes to the next Step G-10.

Step G-10

A decision is made as to whether the note number RK is or is not less than "127". If no, the process returns to the main routine since the overflow processing for the note-FIFO is considered finished.

Step G-11

If yes at the decision made at Step G-10, the note number is incremented by "1" before returning to Step G-2.

In summary, the received data-processing flag is inspected in the order of the note number, because a portion of the messages relating to musical pitch will be lost in case of overflow of the note-FIFO. After such inspection, the new-note map is compared with the older-note map in order that the operated key-processing is executed on the basis of the key operation messages on the new-note map in a case wherein the key operation messages are to be subject to the processing. The operated key-processing may also be modified here in such a manner as suggested in the provision described already for the note-FIFO processing routine.

Instead of providing the new-note map with the data-processing flag, an additional register may be employed to register words each corresponding to a group of note numbers: 0 to 15; 16 to 31; . . . ; or 112 to 127. Thus, sixteen (16) bits will form one word on the additional register. Before Step G-2 starts, those words are inspected one by one to search any word which contains the bit "1". The note number corresponding to this bit is then designated as the already described note number RK. Therefore, this alternative procedure is carried out more quickly than the already described procedure in which the note number for which the received data-processing flag "1" is searched.

In addition to the new and older-note maps, there are utilized in the first embodiment the received data-processing flag and the note-FIFO for the purpose of speed-up in detecting the key operation messages. However, such an operation may be simplified by omitting the procedures which are based on the flag in the note-FIFO processing and/or overflow routines. It is also possible to dispense with the note-FIFO but merely use the note maps wherein only a processing which is the same as or similar to the note-FIFO overflow routine is executed.

Also in the first embodiment, an indicating circuit may be equipped to display the note-FIFO's remaining capacity which may be calculated taking account of current positions of the writing and reading pointers. The indicating circuit may be used to display for a given length of time the note-FIFO's overflow state detected by the overflow detecting flag. Further, the indicating circuit is useful also in displaying the occurrence of such an event that the message of musical pitch pitch is lost during the reception interrupt routine, the event being detected by the value "1" of the received data-processing flag as to the received note number RRK when the new-note map is renewed.

Modifications of the first embodiment will now be described below as to their characteristic features which are different from those of the embodiment.

MODIFICATION-1

It is to be noted that when multiple or overlapping note-on signals given for instance in such a manner as "ON—ON—ON—OFF—OFF—OFF" are received in the first embodiment, the processing is carried out as if a single note-on signal were received for the same note number. In detail, the note-on flag of older-note map turns into "1" upon reception and processing of one note-on signal. This flag causes certain steps including Step F-3 to prevent any successive note-on signals from being subjected to the steps of generating the musical pitch, unless a note-off signal does precede them. However, this MODIFICATION-1 allows each new note-on signal to be processed to generate the tone if it is desirable from the viewpoint of musical effect. The note-FIFO processing routine is changed here for that purpose in the following manner, with the note-FIFO overflow routine being also changed correspondingly.

Note-FIFO Processing Routine

The aforedescribed Steps F3 and F8 are canceled, and Steps F4 and F7 are revised as below. The older-note map is not necessary for this modification so that the renewal procedure thereof is also deleted.

Step F-4

If yes at the decision made at Step F-2 as to whether the received data-processing flag is or is not "1", which flag is for a note number on the new-note map and corresponds to the note number RK, then the reception interrupt is disabled at first before the procedure included in Step F-4 in the first embodiment is executed.

Step F-7

Executed here is a procedure similar or according to the so-called "consecutive strike-processing". When the note-on flag FK is "1" at STAGE-1, the following search is made at first before selection of tone generating channel to which a new musical pitch is to be allotted. This search will be made to seek such a tone generating channel as corresponds to the note number RK and is generating a musical pitch for which a key-release command has not yet been transmitted to the channel. Next, give a command of key-release which is followed by the selection of tone generating channel. Details of the procedures to mute the channel currently generating the musical pitch or to allot the new note-on to a suitable channel are not described here because many methods are feasible and known in the art.

Even if such multiple or overlapping note-on signals are received, the process will be caused to return to the, main routine without conducting any procedure when there is no tone generating channel to which the key-release command can be given.

In summary, the new-note map is not compared with the older-note map, but a decision is made based on the received data processing flag of new-note map only as to whether the key operation messages in issue is or is not to be processed. As to the note-off signal, the new-note map may be compared with the older-note map before the succeeding procedures.

MODIFICATION-2

Where the tone generating channels are allotted in a consecutive manner to the multiple or overlapping note-on signals so as to generate respective musical tones, the new-note map may be provided with an area to register the number of received note-on signals. Correspondingly thereto, the area for the note-on flag on the older-note map may be replaced with an area to register the number note-on signals which are to be processed. The reception interrupt routine and the note-FIFO processing routine are revised in this case in the following manner, with the note-FIFO overflow routine also being revised similarly. Further, the initial state of the received note-on number is "0".

Reception Interrupt Routine

At Step Z-15, the number of received note-on signals is renewed as follows.

With any note-on signal received newly, the number of received note-on is incremented by "1" for the note number which is on the new-note map and corresponds to the received note number RRK. When a note-off signal is received, the abovementioned number of received note-on is decremented by "1" for the note number in the new-note map and corresponding to the received note number RRK, if the number of received note-on is not "0".

Note-FIFO Processing Routine

Steps F3, F4 and F8 are revised similarly to those in MODIFICATION-1. Step F-6 is also revised as shown below, and some procedures are added to Step F-7 which is modified too in part.

Step F-6

The value "0" is set to the received data-processing flag for the note number in the new-note map and corresponding to the note number RK. Next, a decision is made as to whether the note-on flag FK is or is not "1". If yes, the reception interrupts is enabled. If no, a further decision is made as to whether the number of processed note-on signals in the older-note map and corresponding to the note number RK is or is not more than the number of received note-on for the number on the the new-note map. If yes further decision, then the difference between the numbers of the processed and received note-on signals is defined as the number of processed note-off signals NOFF. After that, the number of processed note-on is renewed to be equal to the number of received note-on, before the reception interrupts is enabled. If no, the reception interrupts is simply enabled before the process returns to the main routine.

Step F-7

Where the truncating of the tone generating channel for which a key is in depressed state is effected at STAGE-1, the following procedures are to be executed. The number of processed note-on for the note number in the older-note map and corresponding to the number which has been allotted to the generating channel shall be decremented by "1".

After the command to generate musical pitch is given at STAGE-2, the number of processed note-on is incremented by "1" for the note number in the older-note map and corresponding to the note number RK.

At STAGE-3, the released key-processings are sequentially effected for the number NOFF of tone generating channels corresponding to the note number RK, the number NOFF being the number of processed note-off. Where there are a plurality of tone generating channels which correspond to the note number RK, the released key-processing will be executed starting from for example such a channel for which the note-on signal has been given earliest.

Unprocessed note-off messages may be processed preferentially during the note-on processing. If, for example at Step F-6 in this MODIFICATION-2, the note-on flag FK is indicating "1", the note-on processing will be effected after the unprocessed note-off messages is treated correspondingly when the note-on flag FK is not indicating "1". In other words, a decision will be made at first as to whether the number of processed note-on messages in issue is or is not greater than the number of received note-on messages in issue from which "1" is subtracted. If yes, the processed note-off messages will be designated as the number of received note-on messages minus the number of processed note-on messages plus "1". Subsequently, the number of processed note-on messages will be renewed, and the forbiddance of reception interrupts is canceled. If no, "0" is set at first to the number NOFF of processed note-off messages, and reception interrupts are disabled. On the other hand, if the note-on flag FK is indicating "1" at STAGE-1 of Step F-7, a further decision will be made as to whether the number NOFF of processed note-off messages is or is not greater than "0". If yes, then the procedure defined at STAGE-3 of Step F-7 in this MODIFICATION-2 is carried out to execute the processing of the unprocessed note-off messages, before the selection of unused tone generating channels and other procedures are conducted. If no, any additional procedures will not be carried out before the selection and other procedures.

In summary, the processings in this modification are carried out based on both the numbers of processed and received note-on signals. Multiple note-on signals are thus processed here in such a manner that when any note-on remains unprocessed due to delay of processing, the note-off processing is not effected for such a note-on. Further, if there is found any note-off which remains unprocessed, such a remaining note-off is processed together with another one in issue.

Further, in Step F-6, in case that the note-on flag FK is not "1", the process which is executed when the processed note-on number is not more than the received note-on number can be modified as follows:

A decision is made whether the processed note-on number is more than "0". In case of more than "0", "1" is set to the processed note-off number NOFF. The processed note-on number is decremented by "1". In case of not more than "0", the receive interrupt is enabled and return to the main routine. Alternately, a decision on whether it is a key-operation message to be processed or not can be executed as in the first embodiment.

MODIFICATION-3

It is noted that in the first embodiment the velocity data are renewed on the new-note map so as to carry out the processing to generate musical tones on the basis of the velocity data of the succeeding or note-on when the multiple or overlapping note-on signals are received. Such a processing manner applies also to another case in the first embodiment wherein the signals are received in the order of for instance "ON—OFF—ON" and the latter note-on is received before the former note-on has been processed. However in this MODIFICATION-3, the processing may be effected for one note-on of a velocity value higher than that of the other. For this purpose, the reception interrupt routine as well as the note-FIFO processing routine are revised in the following manner, with the note-FIFO overflow routine being also modified similarly.

Reception Interrupt Routine

Step Z-15, the note number as well as the note-on flag and velocity data following the note number are successively inputted into the note-FIFO.

Note-FIFO Processing Routine

Steps F-1 to F-4 in this routine are modified as follows.

Step F-1

Three (3) bytes are output from the note-FIFO so that they are allotted to the note number RK, note-on flag FK and velocity data RV, in this order.

Step F-3

The reception interrupt is disabled to make a decision whether the value carried by note-on flag FK is or is not the same as that carried by the other note-on flag for the note number in new-note map and corresponding to the note number RK. If no, then the reception interrupt is allowed again and the process returns to the main routine. If yes, a further decision is made as to whether the note-on flag for the note number in the new-note map and corresponding to the note number RK is or is not the same as that of the note-on flag in the older-note map for the note number. If yes, the process skips to Step F-8, but if no, it advances to Step F-4.

Step F-4

The velocity data RV is compared with the other velocity data for the note number in the new-note map and corresponding to the note number RK. The greater data is designated again as the velocity data RV, and the velocity data on the new-note map is renewed. This procedure is employed for receiving and reasonably processing any new key operation messages while the preceding one is processed. After that, the reception interrupts is enabled.

In summary, where note-on flag of key operation messages which is outputted from the note-FIFO is the same as that of the note-on flag on the new-note map, the key operation messages is deemed to be currently in issue or correspond to the preceding data which has not yet been processed. Therefore, the velocity data are compared with each other so that the processing can be effected based on the greater value of the velocity data. It is possible to prefer the velocity data of the preceding note-on wherein the renewal of velocity to the greater value is not effected provided that one of the plural key operation messages remains unprocessed and the note-on flags thereof carry the same value. Similar processing may be effected also for the note-off velocity.

MODIFICATION-4

If the note-on message is to be processed preferentially prior to any note-off message, then two noteFIFOs may be employed, one of them being a note-on FIFO and the other being a note-off FIFO. The reception interrupt routine will be modified such that the note number for each note-on message is inputted into the note-on FIFO, and the note number for each note-off message is inputted into the note-off FIFO. If either the note-on FIFO or note-off FIFO overflows, the overflow processing is to be carried out. Steps D and F of the main routine are respectively divided into two steps for processing every note-on and note-off messages. A preliminary decision is made at first as to whether the note-on FIFO is or is not empty. If no, a processing similar to the note-FIFO processing routine is carried out based on the note number in the note-on FIFO, either generally in all cases or exclusively when the note-on flag on the new-note map is "1". If yes at the preliminary decision, a further decision is made as to whether the note-off FIFO is or is not empty. Then another processing similar to the note-FIFO processing routine is carried out based on the note number in the note-off FIFO, either generally in all cases or exclusively when the note-on flag on the new-note map is "0".

It may be possible that in the note-FIFO overflow processing routine the processing of note-on message is carried out during the first sequence or cycle of the routine, with the processing of note-off message being executed during the second sequence or cycle. In the event that the note-off message is to be preferentially processed prior to the note-on message, the order of the processings may be reversed so that the processing of note-off message is carried out at first. The rules and procedures in MODIFICATION-1, 2 or 3 may be added or applied to this MODIFICATION-4.

MODIFICATION-5

The processing in this modification is feasible provided that: (1) a plurality of CPU can be employed so that some of them are used to effect some portions of the key-release processings, with the aforementioned CPU 22A in the first embodiment thereby effecting the key-release processing at STAGE-3 of Step F-7 in a very short time; and (2) circumstances or relevant conditions allow some portions of the key-release processings to be executed during the reception interrupt routine.

Figures 8, 9:
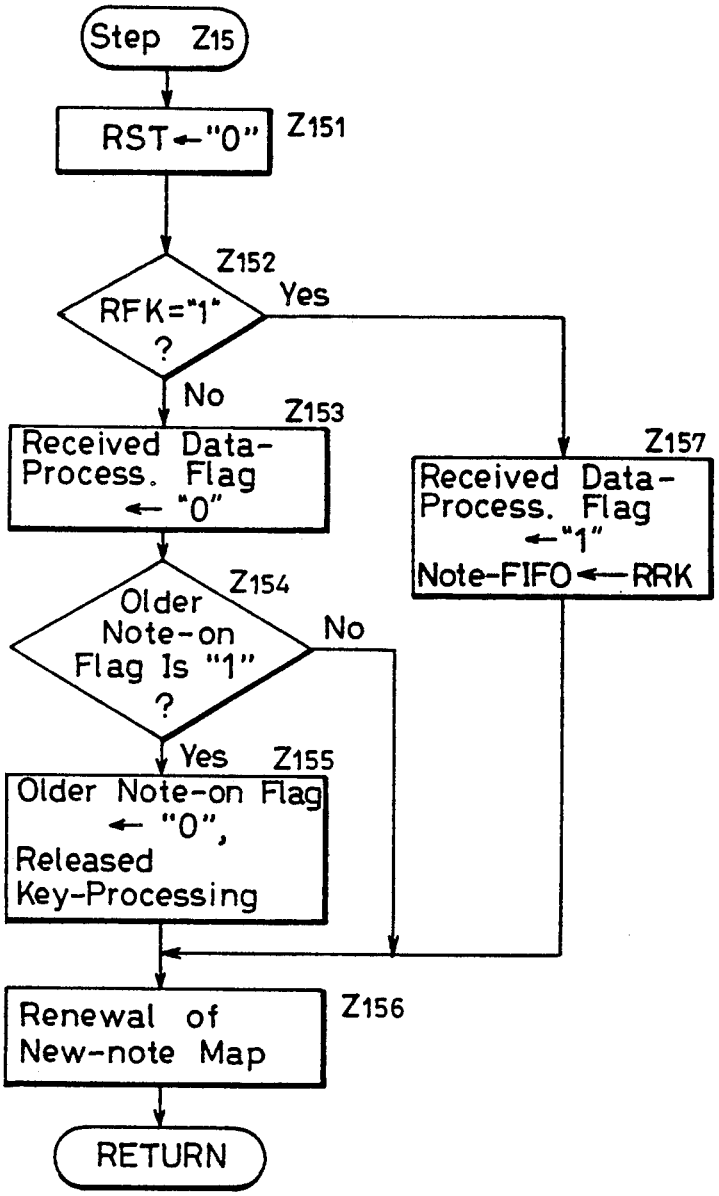

Reception Interrupt Routine (see FIG. 8)

Step Z-15 is modified as follows.

Step Z-151

The value "0" is set to the aforementioned message code RST, with the value "1" being set to the overflow detecting flag FNFOD when the note-FIFO is currently overflowing. If at that time the reception note-on flag RFK is "1", with the received velocity data RRV is "0" at the same time, then "0" and "64" are set to these flag RFK and data RRV, respectively, before the processings start.

Step Z-152

A decision is made as to whether the reception note-on flag RFK is or is not "1", and if yes, the process skips to Step Z-157.

Step Z-153

If no, "0" is set to the received data-processing flag for the note number in the new-note map and corresponding to the received note number RRK.

Step Z-154

A further decision is made as to whether the the other note-on flag is or is not "1" for the note number in the older-note map and corresponding to the received note number RRK. If no, the process advances to Step Z-156.

Step Z-155

If yes, at the "0" is set to the note-on flag of the older-note map, and the released-key processing as defined at STAGE-3 of the Step F-7 is carried out here.

Step Z-156

The note-on flag for the note number in the new-note map and corresponding to the received note number RRK is redesignated as the reception note-on flag RFK, with the current velocity data being also redesignated as the received velocity data RRV before finishing this reception interrupt routine.

Step Z-157

"1" is set to the received data-processing flag for the note number in the new-note map and corresponding to the received note number RRK, with this number RRK being input thereafter into the note-FIFO before advancing to Step Z-156.

Note-FIFO Processing Routine

The processing for the note-off messages is already completed during the reception interrupt routine. Therefore, only the key operation messages for which the note-on flag is "1" on the new-note map need be treated here. It is possible to change the processing in response to the note-on flag. The released-key processing at Step F-7 need not be effected any longer. The event to be avoided here is that any tone would be continuously generated due to a possible delayed processing of the note-on message after completion of the processing of note-off message, when the note-off message is received for the same note number during the operated key processing. The procedures at Steps F5 and F6 are therefore included in the operated key-processing at Step F7. In other words, the following five procedures are sequentially performed: (1) selection of a tone generating channel; (2) calculation of the parameters therefor; (3) Step F-5; (4) issuing a command to generate a musical pitch and the writing in parameters; and (5) Step F-6.

Note-FIFO overflow routine

This routine is modified also similarly to the note-FIFO processing routine.

MODIFICATION-1, 2 or 3 may be adjusted to be applied to this MODIFICATION-5.

MODIFICATION-6

Where a sequencer or the like produces messages to generate percussive sounds, note-on and note-off messages are produced at extraordinarily short intervals of time therebetween. If the processing in the first embodiment were not modified and applied to such a case, then a succeeding note-off message would be received before starting the processing of a preceding note-on message, thereby probably resulting in the missing of said note-on message depending on the use of the tone generating channels. The prior art method which is disclosed in Japanese Laid-open Patent Gazette 61-128295 will be effective to resolve such a problem if combined with the first embodiment for treating the note-on messages. This MODIFICATION-6 partly revises the combination of the method with first embodiment, wherein the received dataprocessing flag is dispensed with. The MODIFICATION-2 described above is adopted here and a velocity-renewing processing is done differently from that in MODIFICATION-3 when the multiple note-on messages are received.

The new-note and older-note maps in this modification are composed as follows.

* New-Note Map (see FIG. 9)

In the new-note map for the note number "0" to "127" used as addresses are: (1) a note-on processing flag showing the progress of the processing of depressed-key messages; (2) a note-on velocity data showing the touch of each depressed key; (3) a note-off processing flag showing the progress of the processing of released-key messages as well as key-depression release (4) a note-off velocity data showing the touch of each released key; and (5) the number of received note-on messages.

In initialized state of the new-note map, the note-on processing flag as well as the note-on velocity data hold the value of "0", the note-off processing flag holds "1", and the note-off velocity data holds the value of "64" and the note-on number is "0".

* Older-Note Map

Corresponding to the new-note map, the number of processed note-on messages in accordance with the note No. from "0" to "127" is in the older-note map. The initial state of the processed note-on number is "0".

Figure 10:
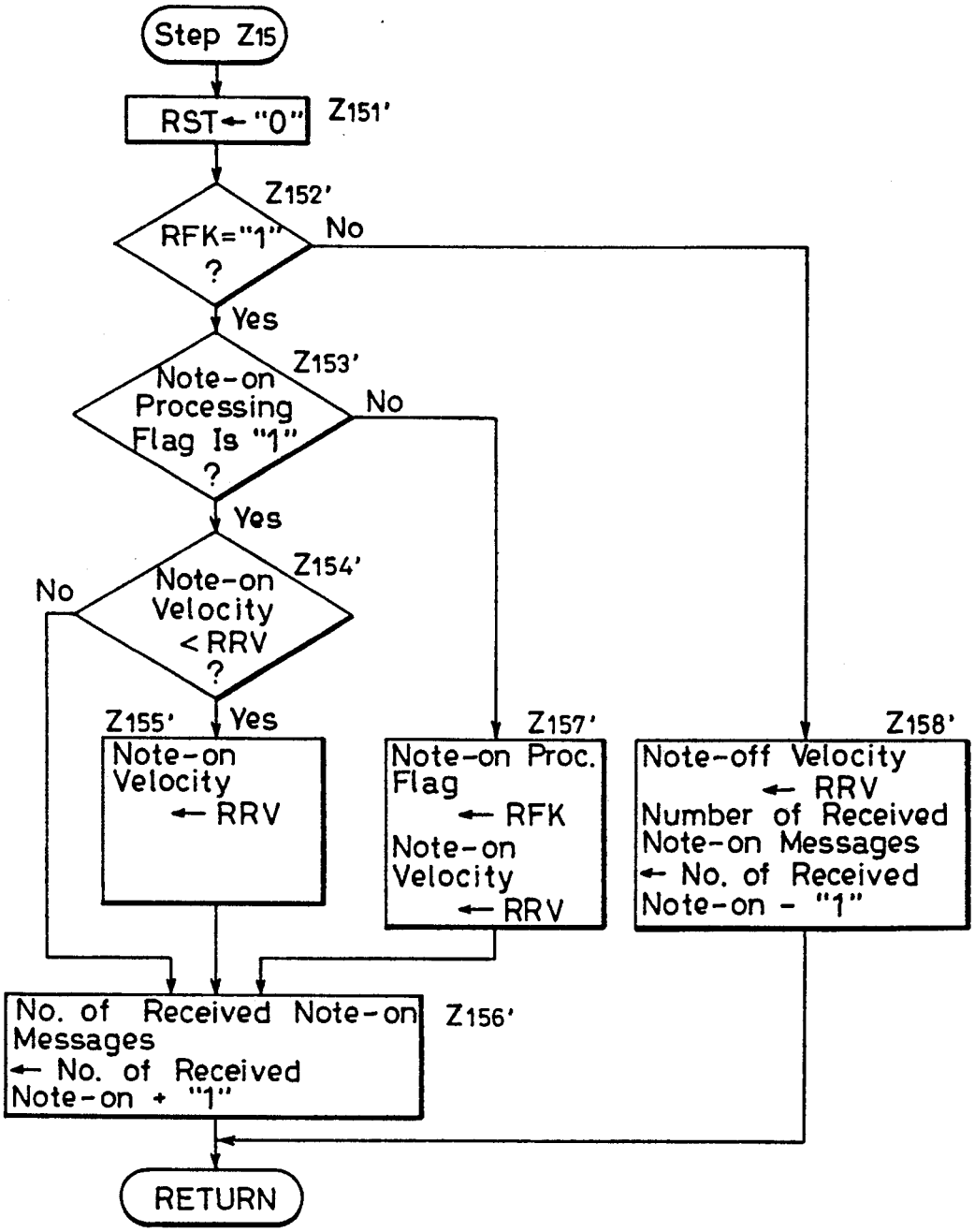

Reception Interrupt Routine (see FIG. 10)

Step Z-15 is modified as follows.

Step Z-151'

The received note number RRK is written in the note-FIFO, with the value "0" being set to the message code RST, and also with the value "1" being set to the overflow detecting flag FNFOD if the note-FIFO is overflowing. If "1" is held on the reception note-on flag RFK is "1", with "0" being held as the received velocity data, "0" is set to the flag RFK, and "64" is set as the data.

Step Z-152'

A decision is made as to whether the reception note-on flag is or is not "1", and if no, the process skips to Step Z-158'.

Step Z-153'

If yes at Step Z-152', a further decision is made as to whether the note-on processing flag is or is not "1" for the note number in the new-note map and corresponding to the received note number RRK. If no, the process advances to Step Z-157'.

Step Z-154'

If yes a still further decision will be made as to whether the note-on velocity for the note number in the new-note map and corresponding to the received note number RRK is or is not less than the received velocity data RRV. If no, the process advances to Step Z-156'.

Step Z-155'

If yes, the note-on velocity for the note number in the new note map and corresponding to the received note number RRK will be renewed to be the received velocity data RRV.

Step Z-156'

The number of received note-on for the note number in the new note map and corresponding to the received note number RRK is incremented by "1", and the reception interrupt routine ends.

Step Z-157'

If no at Step Z-153', the note-on processing flag for the note number in the new note map and corresponding to the received note number RRK is renewed to be the reception note-on flag RFK, with the note-on velocity being renewed at the same time to be the received velocity RRV.

Step Z-158'

If no at Step Z-152', the note-off processing flag for the note number in the new-note map and corresponding to the received note number RRK will be renewed to be "0", with the note-off velocity being also renewed at the same time to be the received velocity RRV. Subsequently, the number of received note-on messages will be decremented by "1" before this reception interrupt routine ends, in case the number is not "0".

It is to be noted that the renew of the note-off velocity may be done similarly to the renewal of note-on velocity. Alternatively, the note-off velocity in the new-note map may be renewed by a note-off message corresponding to the note-on message at the time of renewing the note-on velocity of new note-map. There may be employed a note-off velocity renewal-inhibiting flag for each note number, in view of a fact that each note-off corresponds in general to the closely preceding note-on. This will make it possible that when a "no" at the Step Z-154', the value "1" is set to the relevant renewal inhibiting flag before the process advances next to Step Z-156'. Moreover, it may also be possible that when renewing the note-off velocity a decision is made as to whether the relevant flag for inhibiting the renewal of note-off velocity is or is not indicating "1". If yes, the renewal of note-off velocity is not effected but "0" is reset to the flag. If no, the note-off velocity is renewed.

Figure 11:
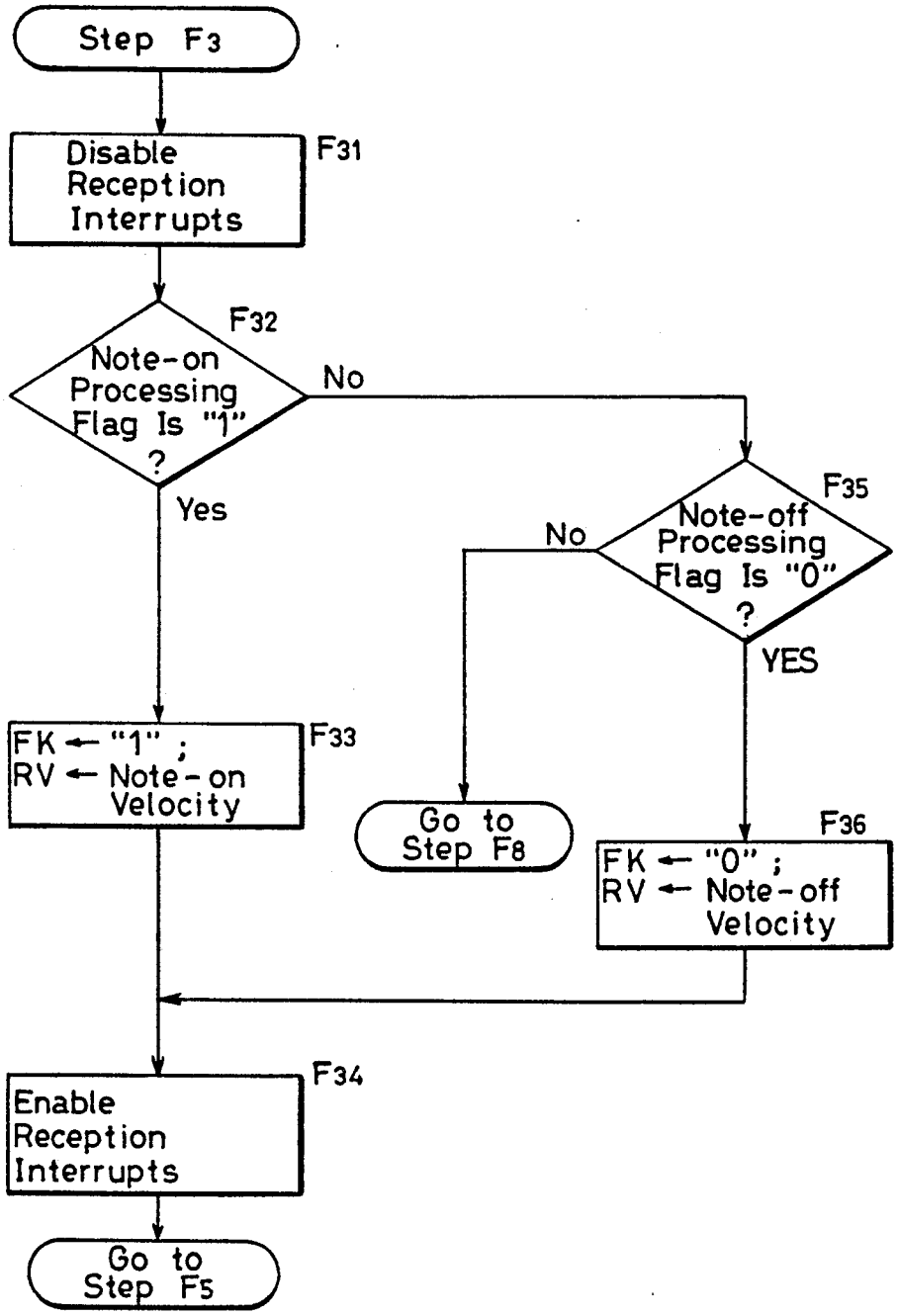
Figure 12:
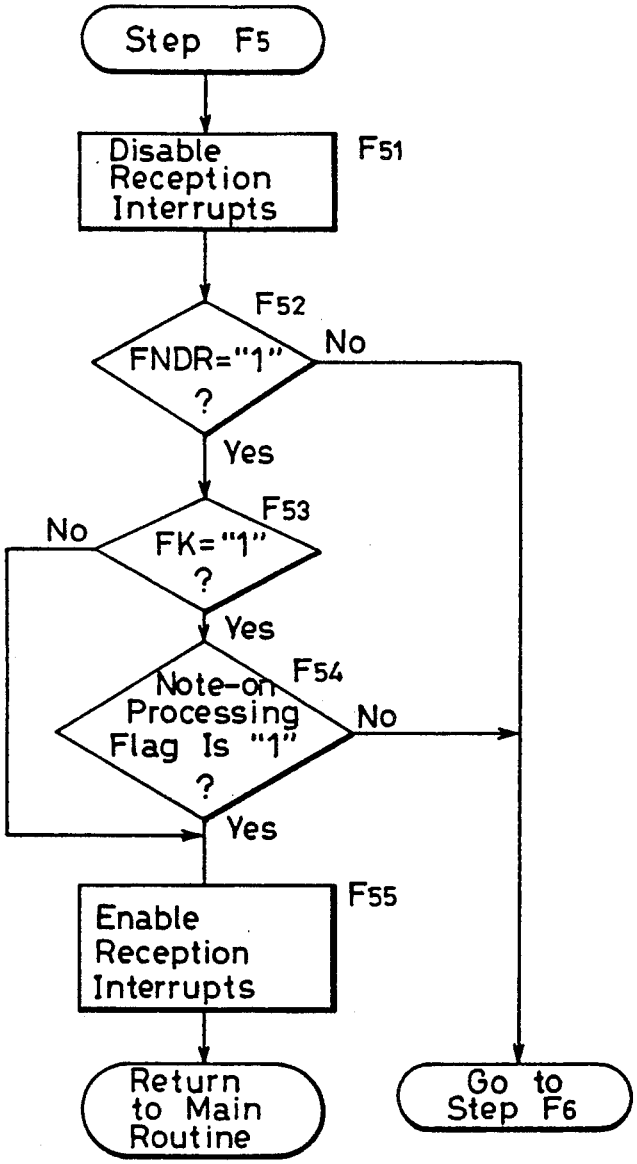
Figure 13:
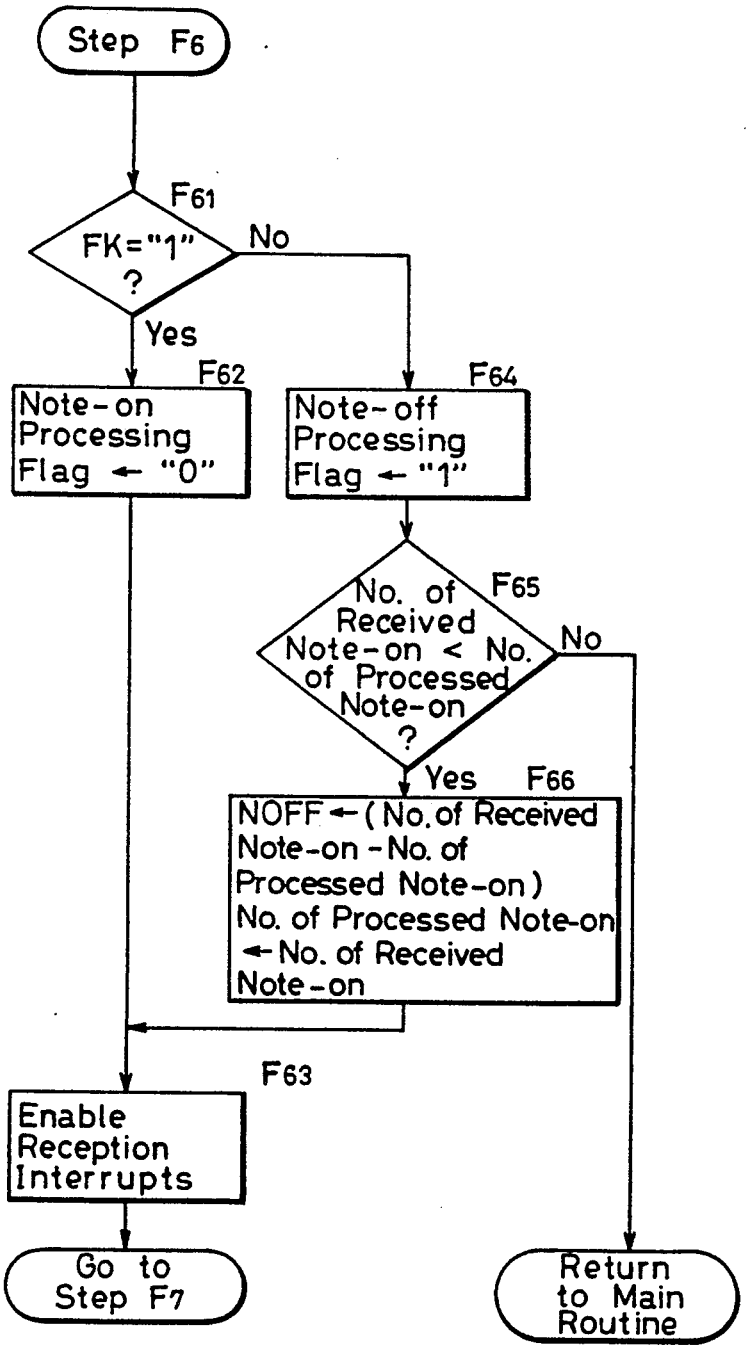

Note-FIFO Processing Routine (see FIGS. 11 to 13)

Steps F-3, F-5 and F-6 are modified as described below, and Step F-7 is revised as in MODIFICATION-2. Step F-2 is omitted so that the process advances directly from Step F-1 to Step F-3. Step F-4 is also omitted.

Modified Step F-3 ( see FIG. 11 )

Step F-31

The reception interrupt is disabled at first.

Step F-32

A decision is made as to whether the note-on processing flag for the note number in the new-note map and corresponding to the note number RK is or is not indicating "1". If no the process goes to Step F-35.

Step F-33

If yes at Step F-32, then "1" is set to the note-on flag FK, and the velocity RV is designated as the note-on velocity for the note number in the new-note map and corresponding to the note number RK.

Step F-34

The reception interrupts is enabled, and the process advances to Step F-5.

Step F-35

If no at Step F-32, further decision is made as to whether the note-off processing flag for the note number in the new-note map and corresponding to the note number RK is or is not indicating "0". If no, the process advances to Step F-8.

Step F-36

If yes at Step F-35, "0" is set to the note-on flag FK, and the velocity RV is designated as the note-off velocity for the note number in the new-note map and corresponding to the note number RK.

In summary, the processing of each note-on is effected in case of the note-on processing flag indicating "1", and the processing of each note-off is effected in case of both the note-on and note-off processing flags indicating "0".

Modified Step F-5 (see FIG. 12)

Step F-51

The reception interrupt is disabled at first.

Step F-52

Next, a decision is made as to whether the data-receiving flag FNDR is or is not indicating "1". If no, the process advances to Step F-6.

Step F-53

If yes at Step F-52, a further decision is made as to whether the note-on flag FK is or is not indicating "1". If no, the process advances to Step F-55.

Step F-54

If yes at Step F-53, a still further decision is made as to whether the note-on processing flag for the note number in the new-note map and corresponding to the note number RK. If no, the process advances to Step F-6.

Step F-55

If yes at Step F-54, then the reception interrupts is enabled so that the process subsequently returns to the main routine.

In summary, the processing of the note-on in issue will be continued in a case wherein the note-off message is received during the processing of the note-on. Where a new note-on is to be duly received, the current processing is stopped.

Modified Step F-6 (see FIG. 13)

Step F-61

A decision is made at first as to whether the note-on flag FK is or is not indicating "1", and if no, the process advances to Step F-64.

Step F-62

If yes at Step F-61, "0" is set to the note-on processing flag for the note number in the new-note map and corresponding to the note number RK.

Step F-63

The reception interrupts is enabled, and the process goes to Step F-7.

Step F-64

If no at Step F-61, "1" is set to the note-on processing flag for the note number in the new-note map and corresponding to the note number RK.

Step F-65

A still further decision is made as to whether the number of received note-on messages for the note number in the new-note map and corresponding to the note number RK is or is not less than the number of processed note-on messages for the note number on the older-note map. If no, the reception interrupts is enabled, and the process returns to the main routine.

Step F-66

If yes at Step F-65, the difference between the numbers of processed and received note-on messages will be designated as the number NOFF of processed note-off messages. Subsequently, the number of processed note-on is renewed to be the number of received note-on, and then the process goes to Step F-63.

Note-FIFO Overflow Routine

This routine is also modified similarly to the note-FIFO processing routine so that two cycles of this routine program are executed in such way that the note-off which will have been received before the preceding note-on is completely processed may be successively processed.

In the MODIFICATION-6, the processing of the velocity data may be designed to be similar to that which is incorporated in the first embodiment or MODIFICATION-3. The multiple note-on messages may be processed in such a manner as in the first embodiment or MODIFICATION-1.

Moreover, this MODIFICATION-6 may be revised to be applied to MODIFICATION-4 or 5. For example, a standby note-off FIFO may be employed to preferentially process the note-off message prior to the note-on message as in MODIFICATION-5. When the note-off is processed in any reception interrupt, this note-off will be inputted into the standby note-off FIFO if the corresponding note-on processing flag is indicating "1". Then, the note-off will be processed according to and using the standby note-off FIFO after the note-on processing will be finished according to the note-on FIFO.

MODIFICATION-7

Although, the overflow of note-FIFO is preferentially processed if it overflows in the first embodiment, the data received during the processing may be treated at first.

Main Routine

Therefore, the order of Steps C and D is reversed so that the process advances to Step D from Step B. If decided at Step D that the note-FIFO is empty, the process goes to Step C where the decision is made as to whether the note-FIFO is or is not overflowing. If no, the process advances to Step E.

Reception Interrupt Routine

Step Z-15 is revised to include additional procedures as follows.

Step Z-15

In case of the note-FIFO overflowing, content of this note-FIFO is cleared by initializing the writing and reading pointers. The value "0" is then set to the note number BRK indicating that the message in issue is being processed in the note-FIFO overflow routine.

Note-FIFO Overflow Routine

Steps G-1, G-10 and G-11 are modified as follows.

Step G-1

After forbidding the reception interrupts, the note number BRK indicating the processing of overflow is designated as the note number RK, before the reception interrupts is enabled.

Step G-10

Instead of deciding the note number RK, a decision is made as to whether the overflow indicating note number BRK is or is not less than "127". If no, "0" is set to the overflow detecting flag FNFOD, and the process returns to the main routine.

Step G-11

If yes at Step G-10, the overflow indicating note number BRK is incremented by "1" before the process returns to the main routine.

This MODIFICATION may be properly revised for combination with any one of the other MODIFICATIONS.

SECOND EMBODIMENT

A second embodiment of the invention will now be described as to its characteristic features different from those of the first embodiment.

Selection of the tone generating channel at Step F-7 in the first embodiment needs the accelerated muting of a musical tone which is being generated, in the event that there is found no idle or unused tone generating channel. In such a case, any undesired noisy tone must be prevented from being generated during the muting process of the selected channel which is to be muted acceleratedly. It however takes a considerable length of time for the selected channel to sufficienty decrease the intensity of the muted tone after the muting command is given. MODIFICATION-5 is referred to here in respect of this problem because the length of time for the CPU 22A to execute the muting procedure can be shortened. Where such an accelerated muting is applicable, it will be desirable to employ some tone generating channels for which the truncating procedure precedes the allotting of musical tones, as described below.

RAM 22C comprises therefore a truncate-FIFO as well as a truncate map. This contains: (1) note-on flags for the respective note numbers "0" to "127" as the addresses; and (2) channel flags corresponding to these note numbers and indicating with "1" the wait status of the channels on standby to be allotted to the musical tones.

A truncating state map is employed here to judge whether the tone generating channels are being muted acceleratedly or not. This map contains accelerated muting flags which correspond to the channel numbers "1" to "16" as the addresses and indicate with "1" that the channel(s) is(are) being truncated.

Figure 14:
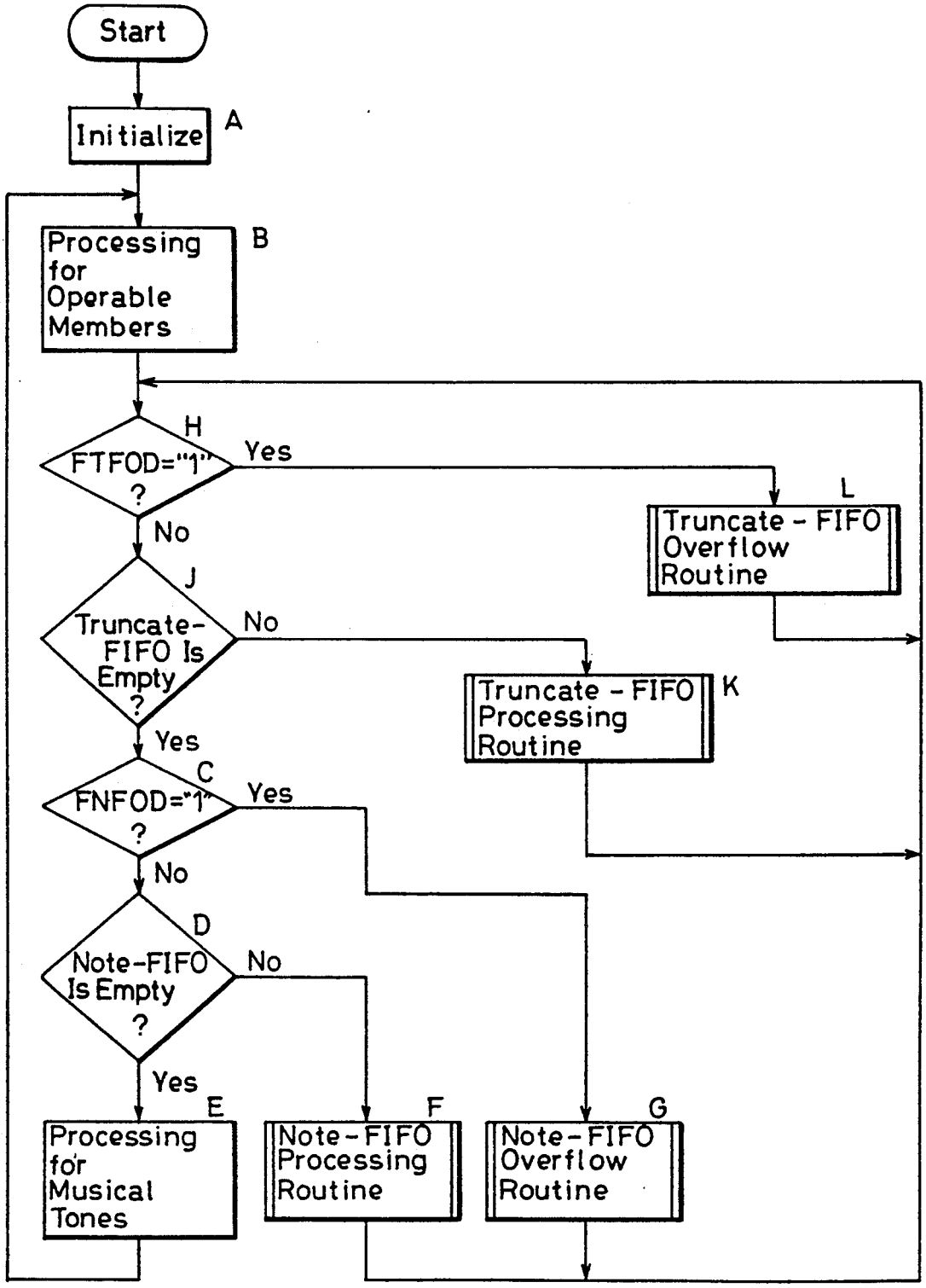
FIGS. 14 and 15 illustrate the electronic musical instrument in a second embodiment of the invention, and are flowcharts of a main routine and a truncate-FIFO processing routine, respectively.

Additionally, other registers are also included to register the number TCN of tone generating channels in use and the number TRN of tone generating channels which are to be muted acceleratedly. As shown in FIG. 14, Steps H to L are added to the main routine included in the first embodiment. In addition, a tone-generation's end interrupt routine is employed, with the note-FIFO processing, note-FIFO overflow and interrupt routines are respectively revised in part. The processing within each tone generating channel is modified, too.

Main Routine

Step H

A decision is made as to whether a truncate overflow-detecting flag FTFOD is or is not indicating "1", and if yes, the process goes to Step L.

Step J

If yes at Step H, a further decision is made as to whether the truncate-FIFO is or is not empty. If yes, the process goes back to Step C, but if no, the process advances to Step K.

Step K

The processing of the truncate-FIFO is carried out, details of which will be given later referring to the flowchart in FIG. 15. After the processing, the process returns to Step H.

Step L

The processing of the overflowing truncate-FIFO is executed here, which processing will be described later in detail. After the processing, the process returns to Step H.

When Steps F and G are finished, the process returns also to Step H.

Reception Interrupt Routine

Besides the procedures at Step Z-15, there is another procedure to write the received note number RRK in the truncate-FIFO. Where this truncate-FIFO is overfowing at that time, "1" is set to the truncate overflow-detecting flag FTFOD.

Figure 15:
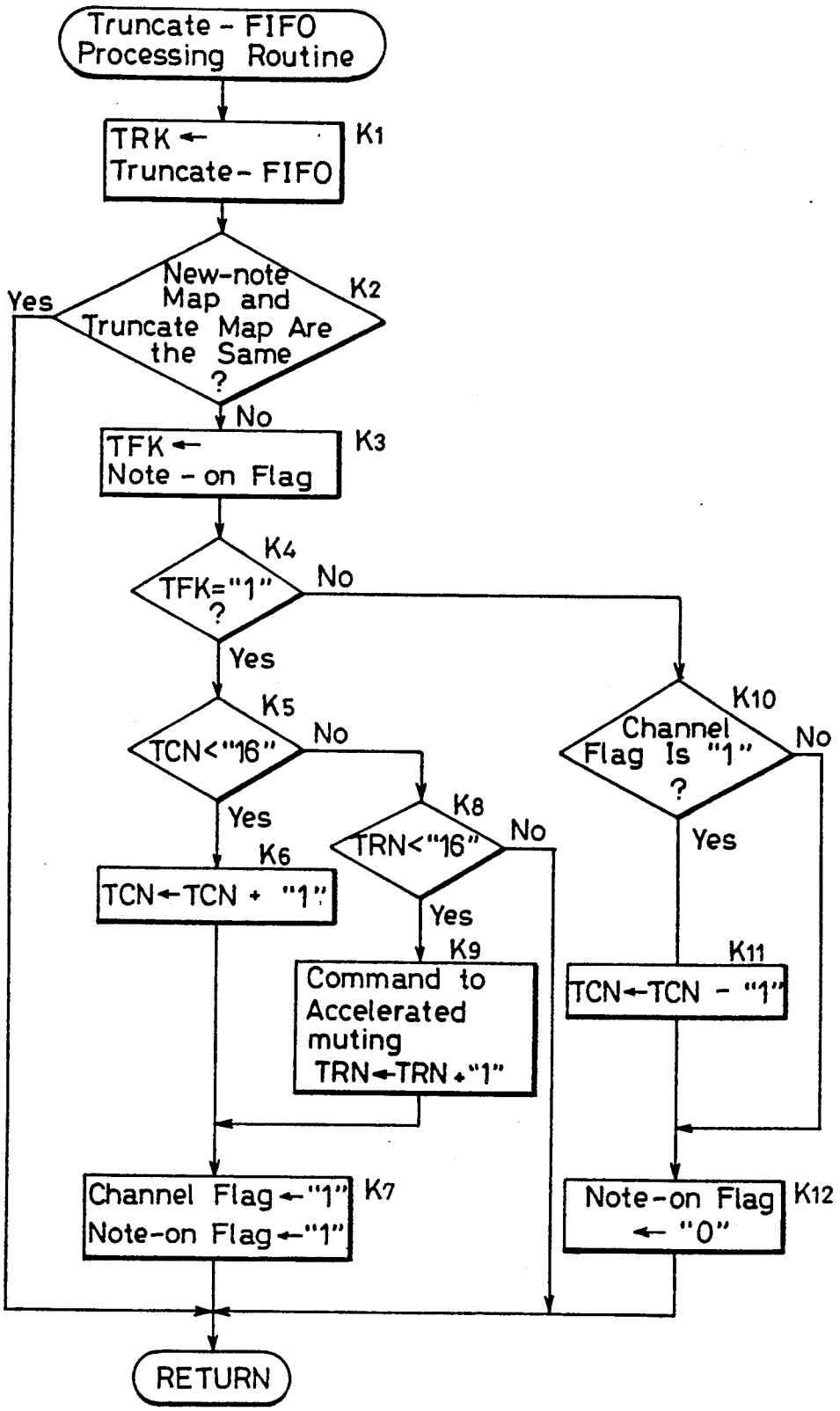

Truncate-FIFO Processing Routine (see FIG. 15)

Step K-1

One byte is outputted from the truncate-FIFO and designated as the truncate note number TRK.

Step K-2

The reception interrupt is disabled in order to make a decision as to whether the note-on flag for the note number registered of the new-note map and corresponding to the truncate note number TRK is or is not indicating the same value as the other value indicated on the note-on flag for the note number on the truncate note map. If yes, the reception interrupt is enabled before the process returns to the main routine.

Step K-3

If no at Step K-2, the value currently carried by the note-on flag for the note number on the new-note map will be designated as the value which is to be carried by the truncate note-on flag. The reception interrupt is enabled thereafter.

Step K-4

A further decision is made as to whether the truncate note-on flag TFK is or is not indicating "1", and if no, the process skips to Step K-10.

Step K-5

If yes at Step K-4,.a still further decision will be made as to whether the used channels number TCN is or is not less than "16". In other words, whether there is or is not any tone generating channel allottable to musical pitch will be decided here. If there is not found such a channel, the process goes to Step K-8.

Step K-6

If there is found such an allottable channel, the tone-generation's end interrupt is disabled at first, and subsequently the used channels number TCN will be decremented by "1" before enabling interrupt.

Step K-7

The value "1" is set to both the channel flag and note-on flag for the note number in the truncate map and corresponding to the truncate note number TRK, before the process returns to the main process.

Step K-8

If there is not found any allottable tone generating channel, another decision is made as to whether the accelerated muting number TRN is or is not less a "16". If no, the process returns to the main routine because all of the tone generating channels are being muted acceleratedly. That is, the note-on message in issue is neglected since there is no tone generating channel to which this message can be allotted.

Step K-9

If yes at Step K-9, one of the tone generating channels for which the accelerated muting flags are not indicating the value "1" is selected so that an accelerated muting command is given to the selected channel. Subsequently, "1" is set to the accelerated muting flag which is in the truncating state map and corresponds to the selected channel. Further, the tone-generation's end interrupt is disabled so that the accelerated muting number TRN can be incremented by "1" before the interrupt is allowed again.

Step K-10

If no at Step K-4, an additional decision is made as to whether the channel flag is or is not indicating "1" for the note number in the truncate map and corresponding to the truncate note number TRK. If no, the process advances to Step K-12 since the command for the musical tone generation has been already given to the note number.

Step K-11

If yes at Step K-10, the tone-generation's end interrupt is disabled so that "0" is set to the channel flag for the note number on the truncate map and corresponding to the truncate note number TRK. After that, the number TCN of used channels is decremented by "1" when the number of used channel is not "0", before the interrupt is allowed again. In other words, a note-on preceding the note-on in issue for the same note number has caused relevant channels ready to be allotted, nevertheless the note-off message was received before the operated key-processing had been executed. As a result, the using of tone generating channel which was to be allotted to the note-on message in issue is withdrawn. In response to this state, "0" is set to the channel flag, with the used channels number TCN being decremented by "1" at this Step K-11 as mentioned above.

Step K-12

The value "0" is set to the note-on flag for the note number in the truncate map and corresponding to the truncate note number TRK, before the process returns to the main routine.

The so-called "consecutive strike-processing" may be executed when the note number of a newly received note-on is the same as that for which musical tone is being generated. In this case, the generating of musical pitch based on the new note-on will be alotted to and carried out through the tone generating channel which is currently generating the musical tone for the same note number. The following procedures are preferable in such a case.

A decision will be made at first, before Step K-5, as to whether there is or is not any tone generating channel which is not being muted acceleratedly but generating a musical pitch for the same note number as the newly received note-on message. If yes, such a tone generating channel is designated as the channel which is to be muted acceleratedly. The process subsequently goes to Step K-9. If no, the process advances to Step K-5.

Truncate-FIFO Overflow Routine

A processing is executed here corresponding to those in the truncate-FIFO processing routine and the note-FIFO overflow routine, in the following manner.

A first, "0" is set to the truncate overflow-detecting flag FTFOD and the truncate note number TRK, and the memory of the truncate-FIFO is cleared. Then, procedures similar to those at Steps K2 to K12 are executed.

It is to be noted however that at the steps corresponding to Steps K2, K7, K8 and K12 the process does not return to the main routine, but instead the following procedure must be carried out.

A decision is made as to whether the truncate note number TRK is or is not less than "127", and if yes, the truncate note number is incremented by "1" before the process returns to such a step which corresponds to Step K-2. It no, the process returns to the main routine.

Note-FIFO Processing Routine

Before the procedure at Step F-6 is started, the channel flag for the note number in the truncate map and corresponding to the note number RK is checked when the note-on flag is indicating "1". With the channel flag indicating "1", the process enters Step F-6. If the flag is not indicating "1", that is, if there was not found in the truncate processing any tone generating channel which is allottable to note-on or is to be muted acceleratedly, the reception interrupts will be enabled causing the process to return to the main routine. With respect to this procedure, consideration is to be given to a possibility that standby state may have been canceled for some channels during a period from the truncate processing routine to the current processing. This means that there may be present some tone generating channel which are allottable to musical tone and/or are capable of being muted acceleratedly. Thus, the procedures similar or corresponding to Steps K5 to K9 may be executed at a time when channel flag for the note number in issue is found not to be indicating "1". It is also alternatively possible that when the channel flag not indicating "1" the process is caused to advance to Step F-6, provided that there is any channel which is allottable to musical pitch or capable of being muted acceleratedly. If such a channel is not found out, the reception interrupt will be canceled causing the process to return to the main routine. Further, when the older-note map is renewed at Step F-6, that is, when the command to generate musical tone is given, the channel flag for the note number in the truncate map and corresponding to the note number RK will be renewed to become "0" indicating that the channel is not in its standby state.

Note-FIFO Overflow Routine

This routine is modified correspondingly to the note-FIFO processing routine.

Tone-generation's end interrupt is charged to CPU 22A by the tone generating channel when it has finished generating the musical tone.

Tone-Generation's End Interrupt Routine

Upon receipt of such tone-generation's interrupt from the tone generating channel, the accelerated muting flag is checked for the channel number in the truncating state map corresponding to the channel which has finished generating musical tone. If the accelerated muting flag is judged by a decision as indicating "1", the accelerated muting number TRN will be decremented by "1" since the musical tone from the acceleratedly muted channel has been muted completely. The accelerated muting flag in the truncating state map and corresponding to the truncated channel is subsequently set to indicate "0". If the accelerated muting flag is judged not indicating "1" at the decision, the number TCN of used channels will be decremented by "1" since the channel has not been muted acceleratedly but has normally finished generating musical tone. In order that selection of the tone generating channel which is to be truncated can be done in a shorter time, the order of the channels to which key-depressions are allotted may be rearranged to correspond either to the order of the key-depressions at the time of each key-depression or to correspond to the order of envelope levels of musical tones which are to be generated, at the time of each of timer interrupts which are charged at regular intervals of time.

Where truncating is to be disabled for each channel in a predetermined short period in which generated tone will be in its predetermined particular state, the number of tone generating channels which are not to truncated may be subtracted from the value "16" at Step K-8.

A proper indicating device may be employed to display the number of used channels, number of acceleratedly muted channels, number of usable channels (i.e., the total of channels minus the used channels), number of channels which are not being muted accelerated, the total of channels minus the accelerated muted channels) and other states such as the neglected note-on messages at Step K-8.

Although the FIFOs are combined with the maps in the second embodiment, it may be possible to employ the truncating flag for each note number so as to execute the same process for the received data-processing flags employed in the first embodiment. A processing may be executed here which corresponds to the processing for the received data-processing. In addition, the truncating for note-off messages may be executed during the reception interrupt routine in a manner similar to MODIFICATION-5. This applies also to the note-on messages.

MODIFICATION of 2nd Embodiment

The second embodiment described above can be combined with any MODIFICATION of the first embodiment. The truncating procedure will be revised as follows for combination with MODIFICATION-2.

The areas for the note-on flags and channel flags are deleted here from the truncate note map so that an area for the truncating flags and an area for the current number of "waiting note-on messages" are defined in the map. The truncating flags mentioned above indicate whether the truncating of each channel is or is not finished based on the relevant key operation messages appearing on the new-note map, and the "waiting note-on messages" are those messages which are to be but have not yet been allotted to the tone generating channels.

Reception Interrupt Routine

The value "1" is set to the truncating flag for the note number on the truncate map and corresponding to the received note number RRK at Step Z-15.

Truncate-FIFO Processing Routine

Step K-12 is deleted, and the other Steps K-2, K-3, K-7, K-10 and K-11 are modified as follows.

Step K-2

Reception interrupts are disabled, and a decision is made as to whether the truncating flag for the note number in the truncate map and corresponding to the truncate note number TRK is currently indicating "1" which means that the truncating procedure is required for that note number. If no, the reception interrupts is enabled causing the process to return to the main routine.

Step K-3

If yes at Step K-2, the value currently carried by the note-on flag for the note number in the new-note map and corresponding to the truncate note number TRK will be designated as the value of the truncate note-on flag TFK. Subsequently, "0" is set to truncating flag for the number on the truncate note map, thereafter enabling the reception interrupts.

Step K-7

The current number of "waiting note-on messages" for the note number in the truncate map and corresponding to the truncate note number TRK is incremented by "1".

Step K-10

A decision is made as to whether the current number of "waiting note-on messages" for the note number in the truncate map and corresponding to the truncate note number TRK is greater than "1" or not. If no, the process returns to the main routine.

Step K-11

If yes at Step K-10, tone-generation's end interrupts are disabled, and the current number of "waiting note-on messages" will be decremented by "1". Further, where the number TCN of used channels is not "0", this number is decremented by "1" thereafter enabling tone-generation's end interrupts. Such a modification as above of this step is made in view of a fact that though the preceding note-on for the note number in issue has been made ready to be allotted to a selected channel, note-off message is received before the operated key-processing is done, whereby the selected channel need no more be allotted to the note-on. Accordingly, both the current number of waiting note-on messages as well as the number of used channels are decremented by "1" as mentioned above.

Truncate-FIFO Overflow Routine

This routine is also modified similarly to the truncate-FIFO processing routine.

Note-FIFO Processing Routine

In the aforementioned procedure which is to be conducted before the processing of Step F-6 starts, the checking of channel flag is substituted with a decision which is made as to whether the number of waiting note-on messages is or is not greater than "1". If yes, this decision, then conducted is the same procedure is conducted as that for a case when the channel flag is indicating "1". On the contrary, if no, the same procedure is conducted as that for a case when the channel flag is not indicating "1". Further, when the older-note map is renewed, the channel flag is not renewed but the number of waiting note-on messages is incremented by "1".

Note-FIFO Overflow Routine

This routine is modified similarly to the note-FIFO processing routine.

In summary, the truncating is controlled relying on the truncating flags and also relying on the number of waiting note-on messages so as to properly treat the multiple note-on.

Finally, it is to be noted that in all of the embodiments and modifications thereof the number of receiving MIDI-channels was supposed to be "1" for the sake of simpler description. It is however possible to employ a plurality of such receiving MIDI-channels wherein a plurality of maps of the same function may be incorporated so that each map corresponds to each MIDI-channel. All of the processings or procedures described heretofore may be effected for each MIDI-channel, with the MIDI-channel numbers written to the FIFOs and is to be used for the processing therein.

Though the key operation messages are received through the MIDI-bus in the embodiments and modifications thereof, the invention can be properly modified to be applied also to such an electronic musical instrument which comprises a key operating portion such as keyboard.

What is claimed is:

1. An electronic musical instrument comprising:

first memory means for sequentially storing at least musical pitches included in received key-depression messages so that the stored musical pitches can be sequentially read from said first memory means according to a first-in first-out scheme;

second memory means for registering the received key-depression messages and corresponding musical pitches included in the received key-depression messages, the key-depression messages including a first type note-on flag which indicates that a command to generate or truncate a musical tone is to be issued, said second memory means being a map-type memory;

third memory means for registering a second type note-on flag and the corresponding musical pitches, said second type note-on flags each indicating whether the command to generate or truncate the musical tone has or has not been issued based on the received key-depression messages, said third memory means being a map-type memory;

reading means for sequentially reading said musical pitches from said first memory means according to a first-in first-out scheme;

comparing means for comparing each first type note-on flag in said second memory means with each second type note-on flag in said third memory means in response to each musical pitch read by said reading means, said comparing means deciding, from the comparison, whether the first type note-on flag and the second type note-on flag have a different state; and processing means for issuing a command to generate or truncate the musical tone in response to said comparing means, with the command being issued based upon the key-depression message registered in said second memory means and including the first type note-on flag corresponding to the musical pitch read by said reading means;

said processing means causing the second type note-on flag, corresponding to the musical pitch read by said reading means, in said third memory means to coincide to the state of the corresponding first type note-on flag.

2. The electronic musical instrument according to claim 1, wherein said second memory means also registers note-on velocity data included in the key-depression messages and are updated with new note-on velocity data only when a processing to generate or truncate the musical tones for current note-on velocity data is completed, in response to the musical pitches includes in the key-depression messages.

3. The electronic musical instrument according to claims 1 or 2, further comprising:

overflow detecting means for deciding whether said first memory means is overflowing;

said comparing means for comparing the first type note-on flag in said second memory means with the second type note-on flag in said third memory means corresponding to the musical pitch read by said reading means if said overflow detecting means decides that said first memory means is not overflowing;

said comparing means for comparing, in a predetermined order, the first type note-on flag in said second memory means for the musical pitches with the second type note-on flags in said third memory means corresponding to each musical pitch if said overflow detecting means decides that said first memory means is overflowing.

4. The electronic musical instrument according to claims 3, further comprising:

indicating means for displaying information indicating that musical pitches are lost when said overflow detecting means has detected that said first memory means is overflowing.

5. An electronic musical instrument comprising:

first memory means for sequentially storing at least musical pitches included in received key-operation messages so that the stored musical pitches can be sequentially read from said first memory means according to a first-in first-out scheme;

second memory means for registering the received key-operation messages and corresponding musical pitches included in the received key-operation messages, the key-operation message including a first type note-on/off flag which indicates that a command to generate or mute a musical tone is to be issued, said second memory means being a map-type memory;

third memory means for registering the received key-operation messages and the corresponding musical pitches, the key-operation messages including second type note-on/off flags, each flag indicating whether the command to generate or mute the musical tone has or has not been issued based on the received key-operation messages, said third memory means being a map-type memory;

reading means for sequentially reading the musical pitches from said first memory means according to a first-in first-out scheme;

comparing means for comparing each first type note-on/off flag in said second memory means with each second type note-on/off flag in said third memory means in response to each musical pitch read by said reading means, so as to decide whether the first type note-on/off flag and the second type note-on/off flag have a different state; and processing means for issuing a command to generate or mute the musical tone in response to said comparing means, with the command being issued based upon the key-operation message registered in said second memory means and including the first type note-on/off flag corresponding to the musical pitch read by said reading means;

said processing means causing the second type note-on/off flag, corresponding to the musical pitch read by said reading means, in said third memory means to coincide to the state of the corresponding first type note-on/off flag.

6. An electronic musical instrument comprising:

first memory means for sequentially storing at least musical pitches included in received key-operation messages so that the stored musical pitches can be sequentially read from said first memory means according to a first-in first-out scheme;

second memory means for registering the received key-operation messages and corresponding musical pitches included in the received key-operation messages, the key-operation message including a first type note-on/off flag which indicates that a command to generate or mute a musical tone is to be issued, together with a first current number of note-on/off flag which is obtained by subtracting a number representing a number of note-on/off flags indicating that the musical tone is to be muted from a number representing a number of note-on/off flags indicating that the musical tone is to be generated, said second memory means being a map-type memory;

third memory means for registering the received key-operation messages and the corresponding musical pitches, the key-operation messages including second type note-on/off flags, each flag indicating whether the command to generate or mute the musical tone has or has not been issued based on the received key-operation messages, together with a second current number of note-on/off flags which is obtained by subtracting a number representing a number of the note-on/off flags indicating that the command to mute musical tone has been issued from a number representing a number of the note-on/off flags indicating that the command to generate has been issued, said third memory means being a map-type memory;

reading means for sequentially reading the musical pitches from said first memory means according to a first-in first-out scheme;

comparing means for comparing each first type note-on/off flag in said second memory means with each second type note-on/off flag in said third memory means in response to each musical pitch read by said reading means, so as to decide whether the first type note-on/off flag and the second type note-on/off flag have a different state; said comparing means further comparing whether a number of remaining note-on/off flags obtained by subtracting the first current number of note-on/off flags from the second current number of note-on/off flags is more than a predetermined number; and processing means for issuing a command to generate the musical tone in response to said comparing means, with the command being issued based upon the key-operation message which has been registered in said second memory means and including the first type of the note-on/off flag corresponding to the musical pitch read by said reading means;

said processing means causing the second type note-on/off flag, corresponding to the musical pitch read by said reading means, in said third memory means to coincide to the state of the corresponding first type note-on/off flag.

said processing means preferentially executing note-off processings a number times that correspond to said number of remaining note-on/off flags when said number is more than the predetermined number.

7. The electronic musical instrument according to claims 5 or 6, wherein said second memory means registers note-on/off velocity data included in the key-operation messages and are updated with new note-on/off velocity data only when processing to generate the musical tones for current note-on/off velocity data is completed, in response to the musical pitch included in the key-operation messages.

8. The electronic musical instrument according to claims 5 or 6, further comprising:

overflow detecting means for deciding whether said first memory means is overflowing;

said comparing means for comparing the first type note-on/off flag in said second memory means with the second type note-on/off flag in said third memory means corresponding to the musical pitch read by said reading means if said overflow detecting means decides that said first memory means is not overflowing;

said comparing means for comparing, in a predetermined order, the first type note-on/off flags in said second memory means with the second type note-on/off flag in said third memory means corresponding to each musical pitch if said overflow detecting means decides that said first memory means is overflowing.

9. The electronic musical instrument according to claims 8, further comprising:

indicating means displaying the information indicating that the musical pitches are lost when said overflow detecting means has detected that said first memory means is overflowing.

10. The electronic musical instrument comprising:

first memory means for sequentially storing at least musical pitches included in received key-operation messages so that the stored musical pitches can be sequentially read from said first memory means according to a first-in first-out scheme;

second memory means, being a map-type memory, for registering the received key-depression messages and corresponding musical pitches included in the received key-depression messages, the key-depression messages including a note-on flag which indicates that a command to generate or truncate the musical tone is to be issued;

third memory means, being a map-type memory, for registering state data representing a processing to generate or truncate the musical tone based on the received key-depression messages, and the corresponding musical pitches;

setting means for updating contents of the state data which have been registered in said third memory means and corresponding musical pitches so as to indicate an unprocessed state;

reading means for sequentially reading the musical pitches out from said first memory means according to a first-in first-out scheme;

detecting means for deciding whether each state data registered in said third memory means indicates an unprocessed state in response to each musical pitch read by said reading means; and processing means for issuing commands to said musical tone-generating means to generate or truncate the musical tone when said detecting means has decided that the musical pitch is unprocessed, said command being issued based upon the key-depression message registered in said second memory means;

said processing means modifying contents of the state data in said third memory means so as to indicate that the musical pitch has been processed.

11. The electronic musical instrument according to claims 1 or 10, wherein said second memory means registers note-on velocity data included in the key-depression messages and are updated with new note-on velocity data only when the new note-on velocity data are greater than current note-on velocity data in an unprocessed state for generating or truncating the musical tone, in response to the musical pitch included in the key-depression messages.

12. The electronic musical instrument according to claim 10, wherein said second memory means registers note-on velocity data which are included in the key-depression messages and are updated with new note-on velocity data only when contents of the state data registered in said third memory means indicates that the musical pitch has been processed, in response to the musical pitch included in the key-depression messages.

13. The electronic musical instrument comprising:

first memory means for sequentially storing at least musical pitches included in received key-operation messages so that the stored musical pitches can be sequentially read from said first memory means according to a first-in first-out scheme;

second memory means, being a map-type memory, for registering the received key-depression messages and corresponding musical pitches included in the received key-operation messages, the key-operation messages including a note-on flag which indicates that a command to generate or mute the musical tone is to be issued;

third memory means, being a map-type memory, for registering state data representing a processing to generate or mute the musical tone based on the received key-operation messages, the corresponding musical pitches;

setting means for updating contents of the state data which has been registered in said third memory means and corresponding musical pitches so as to indicate an unprocessed state;

reading means for sequentially reading the musical pitches out from said first memory means according to a first-in first-out scheme;

detecting means for deciding whether each state data registered in said third memory means indicates an unprocessed state in response to each musical pitch read by said reading means; and processing means for issuing commands to said musical tone-generating means to generate or mute the musical tone when said detecting means has decided that the musical pitch is unprocessed, said command being issued based upon the key-operation message registered in said second memory means;

said processing means modifying contents of the state data in said third memory means so as to indicate that the musical pitch has been processed.

14. An electronic musical instrument comprising:

first memory means for sequentially storing at least musical pitches included in received key-operation messages so that the stored musical pitches can be sequentially read from said first memory means according to a first-in first-out scheme;

second memory means, being a map-type memory, for registering the received key-depression messages and corresponding musical pitches included in the received key-operation messages, the key-operation messages including a first type note-on/off flag which indicates that a command to generate or mute a musical tone is to be issued; together with a first current number of note-on/off flags which is obtained by subtracting a number representing a number of note-on/off flags indicating that the musical tone is to be muted from a number representing a number of note-on/off flags indicating that the musical tone is to be generated;

third memory means, being a map-type memory, for registering state data representing a processing to generate or mute the musical tone and corresponding musical pitches, together with a second current number of note-on/off flags which is obtained by subtracting a number representing a number of note-on/off flags indicating that the command to mute musical tone has been issued from a number representing a number of note-on/off flags indicating that the command to generate musical tone has been issued;

setting means for updating contents of the state data which have been registered in said third memory means and corresponding musical pitches so as to indicate an unprocessed state;

reading means for sequentially reading the musical pitches from said first memory means according to a first-in first-out scheme;

comparing means for comparing whether a number of remaining note-on/off flags obtained by subtracting the first current number of note-on/off flags from the second current number of note-on/off flags is more than a predetermined number in response to each musical pitch read by said reading means;

detecting means for deciding whether each state data registered in said third memory means indicates an unprocessed state in response to each musical pitch read by said reading means; and processing means for issuing commands to generate or mute the musical tone when said detecting means has decided that the musical pitch is unprocessed, the command being issued based upon the key-operation messages been registered in said second memory means;

said processing means modifying contents of the state data in said third memory means so as to indicate that the musical pitch has been processed;

said processing means preferentially executing note-on/off processings a number of times that correspond to said number of remaining note-on/off flags when said number is more than the predetermined number.

15. The electronic musical instrument according to claims 5, 6, 13, or 14, wherein said second memory means registers note-on velocity data which are included in the key-operation messages and are updated with new note-on velocity data only when the new note-on/off velocity data are greater than a current note-on/off velocity data in an unprocessed state for generating the musical tone, in response to the musical pitch included in the key-operation messages.

16. The electronic musical instrument according to claims 13 or 14, wherein said second memory means registers current note-on velocity data which are included in the key-operation messages and are updated with new note-on/off velocity data only when contents of the state data registered in said third memory means indicates that the musical pitch has been processed, in response to the musical pitch included in the key-operation messages.

17. The electronic musical instrument according to claims 10, 13 or 14, further comprising:

overflow detecting means for deciding whether said first memory means is overflowing;

said detecting means deciding whether contents of the state data registered in said third memory means indicates that the musical pitch is unprocessed corresponding to the musical pitch read by said reading means if said overflow detecting means decides that said first memory means is not overflowing;

said detecting means deciding, in a predetermined order, whether the contents of the state date registered in said third memory means indicates that the musical pitches is unprocessed corresponding to each musical pitch if said overflow detecting means decides that said first memory means is overflowing.

18. The electronic musical instrument according to claim 17, further comprising:

indicating means for displaying information indicating that musical pitches are lost when said overflow detecting means has detected that said first memory means is overflowing.

* * * * *